US005311739A

United States Patent [19]

Clark

[11] Patent Number: 5,311,739

[45] Date of Patent: May 17, 1994

[54] EXTERNAL COMBUSTION ENGINE

[76] Inventor: Garry E. Clark, 853 Stone Mill Manor, Lithonia, Ga. 30058

[21] Appl. No.: 843,996

[22] Filed: Feb. 28, 1992

[51] Int. Cl.[5] ..... F02G 3/02

[52] U.S. Cl. ..... 60/39.6; 92/159; 417/438

[58] Field of Search ..... 60/39.6, 39.62, 39.63; 123/236, 237, 238, 78 A, 78 AA; 417/438

[56] References Cited

U.S. PATENT DOCUMENTS

| | | | |
|---|---|---|---|
| 581,385 | 4/1897 | Woillard | 60/39.6 X |
| 713,366 | 11/1902 | Wallmann . | |
| 724,239 | 3/1903 | Babled . | |
| 1,038,970 | 9/1912 | Rydberg . | |
| 1,111,841 | 9/1914 | Koenig . | |
| 1,156,534 | 10/1915 | Latady . | |
| 1,302,582 | 5/1919 | Norman | 60/39.63 |
| 2,078,887 | 4/1937 | Wood | 123/214 |
| 2,127,222 | 8/1938 | Koch | 60/39.62 X |
| 2,334,688 | 11/1943 | Norton . | |
| 3,811,271 | 5/1974 | Sprain . | |
| 4,040,400 | 8/1977 | Kiener . | |
| 4,111,164 | 9/1978 | Wuerfel . | |
| 4,190,024 | 2/1980 | Davis . | |
| 4,202,300 | 5/1980 | Skay . | |
| 4,230,075 | 10/1980 | Lowther . | |
| 4,300,486 | 11/1981 | Lowther . | |
| 4,333,424 | 6/1982 | McFee . | |
| 4,369,623 | 1/1983 | Johnson . | |
| 4,459,084 | 7/1984 | Clark . | |
| 4,513,568 | 4/1985 | Bajulaz . | |
| 4,541,243 | 9/1985 | Clark . | |
| 4,592,309 | 6/1986 | Williams . | |
| 4,606,708 | 8/1986 | Clark . | |
| 4,637,209 | 1/1987 | Clark . | |
| 4,696,158 | 9/1987 | DeFrancisco | 60/39.62 |
| 4,890,585 | 1/1990 | Hathorn . | |

FOREIGN PATENT DOCUMENTS

| | | | |
|---|---|---|---|
| 448649 | 5/1948 | Canada | 60/39.6 |

OTHER PUBLICATIONS

SAE Technical Paper Series No. 880014, "Low-Heat Rejection Engines-A Concept Review", by Randolph A. Churchill et al., Feb. 29-Mar. 4, 1988, pp. 25-36.

SAE Technical Paper Series No. 891866, "Diesel Engines with Extended Expansion Strokes", by J. A. C. Kentfield, Sep. 11-14, 1989 pp. 1-10.

SAE Technical Paper Series No. 861193, "Construction Specialties of Regenerative Piston Internal Combustion Engines", by Radislav Pavletic et al., Sep. 8-11, 1986, pp. 1-6.

SAE Technical Paper Series No. 890473, "A First Look Into The Regenerative Engine", by Francisco Ruiz, Feb. 27-Mar. 3, 1989, pp. 1-12.

SAE Technical Paper Series No. 870339, "Heat Insulation of Combustion Chamber Walls-A Measure To Decrease the Fuel Consumption of I.C. Engines?", by Gerhard Woschni et al., Feb. 23-27, 1987, pp. 1-11.

(List continued on next page.)

*Primary Examiner*—Michael Koczo

*Attorney, Agent, or Firm*—Jones & Askew

[57] ABSTRACT

An improved efficiency external combustion engine which utilizes separation on the thermodynamic processes that occur in an external combustion engine into components designed to maximum each operation. The external combustion engine varies flow volume of air to the combustor in response to power demands and delivers fuel to the combustor at a constant air-to-fuel ratio. The system further comprises separate compressors, combustors and expanders wherein the compressor utilizes isothermal compression, the combustor utilizes constant pressure or constant volume combustion or a combination of the two and may provide final compression, and the expander may utilize subatmospheric expansion. Exhaust heat may be regenerated and used in the primary cycle. The engine also comprises a positive lubrication system for the cylinders and pistons that allows a constant flow of a lubricant around the piston. A wide variance valve control mechanism is introduced which offers varied valve timings.

41 Claims, 10 Drawing Sheets

OTHER PUBLICATIONS

SAE Technical Paper Series No. 890677, "Variable Valve Closure Timing for Load Control and the Otto Atkinson Cycle Engine", by R. J. Saunders et al., Feb. 27-Mar. 3, 1989, pp. 1-11.

SAE Technical Paper Series No. 880602, "An Integrated, Full Authority, Electrohydraulic Engine Valve and Diesel Fuel Injection System", by J. E. Mardell et al., Feb. 29-Mar. 4, 1988, pp. 1-10.

SAE Technical Paper Series No. 891673, "A Pulsed-Combustion Engine", by Kenneth W. Porter, Aug. 7-10, 1989, pp. 1-6.

SAE Technical Paper Series No. 690045, "Proposed Reciprocating Internal Combustion Engine with Constant Pressure Combustion", by Glenn B. Warren et al., Jan. 13-17, 1969, pp. 1-20.

SAE Technical Paper Series No. 880176, "A New Two-Stroke Engine with Compressed-Air Assisted Fuel Injection for High Efficiency Low Emissions Applications", by Pierre Duret et al., Feb. 29-Mar. 4, 1999, pp. 1-15.

SAE Technical Paper Series No. 860534, "The Bajulaz Cycle: A Two-Chamber Internal Combustion Engine with Increased Thermal Efficiency", by W. W. Yuen et al., Feb. 24-28, 28, 1986, pp. 1-10.

John H. Stang, "Insulated Pistons Raise Diesel Efficiency", 1978 Society of Automotive Engineers, Inc., pp. 72-76.

EXTERNAL COMBUSTION ENGINE

TECHNICAL FIELD

The present invention relates to improving external combustion power sources, and more particularly relates to an external combustion engine with improved lubrication, lower emissions, and maximized efficiency over the entire working range of the engine. The invention utilizes separate compressors, combustors and expanders to allow for greater expansion ratios and reuses otherwise wasted heat energy in the primary cycle to increase efficiency.

BACKGROUND OF THE INVENTION

Combustion engines have been used for years in various transportation applications. These engines offer high power output in a relatively small space and give good response to power changes. However, existing engine efficiency varies with the output level of the engine. The engines exhibit poor efficiency at low power but the efficiency improves as load increases until a maximum is reached at the design output point of the engine. Large amounts of heat generated by the burning fuel are lost in the exhaust system and in the cooling process required to maintain safe working temperatures of the metal parts. Thus, there is a need to recapture and use this wasted heat energy and improve efficiency over the entire load range of the engine.

A number of inefficiencies exist in present combustion engines because of their basic structure and operation. Due to a limited amount of time between cycles, fuel is added quickly to compressed air before ignition. There is a need for the fuel to be injected earlier or over a longer period of time so a proper stoichiometric mixture of air and fuel may be had. Also, the expansion rate is affected by the rigid connection of the piston to the output of the engine. This combination of events can cause unwanted high pressure and transient temperature spikes that can result in excessive pollution emissions and noise.

Many attempts at increasing efficiency at the design rating of combustion engines have been made. However, the design horsepower of an engine powering a vehicle such as an automobile is seldom used. The normal driving cycle of an automobile generally requires minimum engine horsepower, a point where poor efficiency will exist even in the advanced engine development concepts presently underway. Under-powering the vehicle has been a ready, although undesirable, alternative way to increase efficiency.

It is expected that the adiabatic engine will provide the most thermally efficient cycle with the majority of the heat of fuel being transferred into mechanical work and exhaust gas. Isolating each step of the combustion process is considered to be the best method to create an adiabatic engine. One such attempt is the engine of the "Brayton" type, i.e., one employing separate compressors and combustion chambers. The separate air compressor is used for receiving and compressing a flow of air to a given pressure to provide compressed air to a separate point where combustion takes place. Many United States patents teach compression external to the combustion area; see, for example, U.S. Pat. Nos. 713,366; 724,239; 1,038,970; 1,111,841; 1,156,534; 3,811,271; 4,040,400; 4,230,075; 4,300,486; 4,333,424; 4,369,623; and 4,592,309. In order to maximize efficiency, some of these applications attempt to extract heat during compression of the air in order to provide a denser air charge in the combustion cylinder. The engines shown in these patents use a multi-stage compressor which is not the most adequate solution to achieving maximum efficiency, because it does not remove heat immediately as pressure is increased.

The majority of existing combustion engines compress the air and burn the fuel in the sat-ne cylinder. This operation causes the fuel to burn while the piston is moving, which results in less expansion for all of the burning fuel and therefore reduces efficiency. A thermodynamic advantage that has been employed to avoid this problem is positioning the combustion chamber external to the expansion or positive displacement chamber. This permits a greater independence of the fuel and combustion temperature used and allows greater flexibility in ignition timing. In order to maximize efficiency, expansion must continue to as low a temperature as possible. Present combustion engines typically do not provide expansion to a temperature as low as possible. In addition to allowing maximum expansion, there is a need to use separate combustion and expansion chambers to avoid high heat conduction from the chambers to other parts of the engine. As the fuel burns in the combustion chamber, the highest temperatures in the cycle are presented to the metal parts. The total surface area of the combustion chamber exposed to these temperatures as the fuel is burning has a direct bearing on the amount of heat transferred to the metal parts, which in turn affects the efficiency of the engine. Present engines that burn the fuel in the same chamber as expansion occurs present a large metal area to the hot burning fuel.

Another attempt towards operating an optimally functioning combustion engine is to maintain constant or near constant pressure in the combustion chamber throughout all operating ranges. Most attempts to achieve this constant pressure are by use of a variable volume combustion chamber, which causes the compression ratio to vary. An effort at providing these variable volume combustion chambers is disclosed in U.S. Pat. No. 4,890,585. The volumes of combustion chambers are adjusted by mechanical controls and/or suitable electro-mechanical controls. However, the present systems do not limit pressure/temperature spikes or allow for control of the air per cycle; therefore, the air-to-fuel ratio must be varied to vary the power. There is a need to control the volume of air per cycle to increase the expansion ratio to a maximum and lower the peak temperatures of the engine to reduce emissions. There is also a need to extend the expansion ratio so that the hot gases may be expanded to an optimum temperature level. Such expansion would reduce operating temperature of the engine because the energy removed from the hot gas will equal that of an engine with a lower expansion ratio operating at a higher operating temperature.

There is a need for an engine capable of operating at a nearly constant air-to-fuel ratio which would allow use of maximum fuel and minimum air at low power to maximize efficiency. The reduced efficiency at low power operation in an combustion engine is due to the manner in which it operates. When an engine with a fixed volume at top dead center is operated at a fractional load, the compression ratio is reduced and/or the air to fuel ratio is increased to limit the power output. This is done mainly by throttling the air to limit its flow during the intake process or by lowering the amount of fuel used. In the first instance, the compression ratio is reduced which also reduces the expansion ratio and the efficiency of the engine; in the second instance the amount of air flowing through the engine at minimum power is almost the same as if the maximum fuel was being used. This causes low combustion temperatures resulting in incomplete burning of the fuel. Therefore, the friction and air compression losses remain nearly constant from minimum to maximum power. These losses use a significant percentage of the power produced by the burning fuel at low power output. Thus, there is a need for either the compression ratio or the air to fuel ratio to stay constant and a need to reduce friction losses of sliding parts so that a larger percentage of the power produced by the burning fuel will be converted to useful work.

Present engines exhibit excessive pollution during cold startup. This is due to the fact that catalytic convertors in the exhaust system require high temperatures to work properly; thus, the engine must run for some time before the exhaust gas heats the elements of the catalytic convertor to operating temperature. The convertors also must be of sufficient size to handle the volume of low pressure exhaust gas. Due to this large size requirement, more of the rare elements used in the convertors are needed to cover the area over which the exhaust gases must pass. This increases the cost of the convertor. Thus, there is a need for the catalytic convertor to be located in the engine system at a point where gases are at a higher temperature and lesser volume to reduce cost, improve operation, and limit the quantity of rare earth elements used.

Existing two stroke combustion engines utilize the outward stroke of the piston to pressurize an air storage space at a pressure slightly above ambient. This compressed air is used to blow out the exhaust from the previous power stroke and fill the cylinder with fresh air. The two stroke engine is affected by friction losses to a lesser degree than a four stroke engine because the friction of the rings moving against the cylinder wall is present whether the piston is moving in or out of the cylinder. In the two stroke engine the affect of this compression on the downward stroke is minimal because the air is only slightly compressed. Thus, the two stroke engine design maximizes the use of the piston moving back and forth in the cylinder to increase efficiency of operation. There is a need to better utilize this design in the modem day combustion engines.

In the operation of present day combustion engines, there is a conflict between the need to lower peak-temperatures of the system to reduce emissions and the need to raise peak temperatures to increase efficiency. The peak temperatures in the combustion engine contribute to the amount of pollution emissions emitted in the engines exhaust, especially NOx. The higher the peak temperature the higher the emission levels. Although lowering the peak temperature may reduce emissions, it also reduces efficiency of the present day engine. In order to provide maximum efficiency, present combustion engines must run at high compression ratios. These high compression ratios cause the compressed air to reach extremely elevated temperatures, and when the fuel burns, the temperature of the burned gas is elevated even further. Thus, there is a need to lower the compression temperature and peak temperature to reduce emissions while at the same time provide maximum efficiency of operation.

Another need in present combustion engines is a wider range of valve control. Present engines operate over a wide range of speeds and the valve operation is typically controlled by cain lobes. It is known that the valve operation is optimized at a certain speed. One attempt to vary the optimum speed point is by using a two step method. However, this is not the optimal method for controlling valves. All increase in the range of control of the valves would improve operation of the engine over a wider speed range.

Current engines operate with a splash type of lubrication system for piston rings. The oil is either sprayed or splashed onto the sides of the cylinder and connecting rod bearing to provide lubrication and removal of heat. Special oil rings are used to help to distribute an oil film on the cylinder walls. During start-up, damage can be done to the cylinder walls because the oil tends to drain off the walls while the engine is not in use. This can cause dry spots which can shorten the life of the engine. Also, this operation limits the effective use that can be made by the bottom movement of the piston. Thus, there is a need to develop a lubrication system that eliminates the dry spot defects inherent in present piston ring lubrication and also increase the effective use of the bottom movement of the piston.

It is known that the sliding friction of piston rings on cylinder walls of present combustion engines is one of the major friction loss generators in the engine. Also, present liquid lubricants can only operate at low to moderate temperature levels and are known to burn in extremely hot combustion cylinders which causes pollution emission problems. It is also known that if the engine parts could operate at elevated temperatures, better efficiency can be expected. Thus, there is a need to use a lubricant with a much higher temperature of degradation that also provides a minimum amount of faction.

Many other concepts have been used in the prior art to improve efficiency of combustion engines. Among these are the use of regenerative braking. Regenerative braking is the slowing of the engine by employing it as a compressor to compress air. Another method of improving efficiency is the use of the heat of exhaust to beat the cooler temperature compressed air before combustion. Add-on bottoming cycles are sometimes used to recapture some of the exhaust heat to improve efficiency; however, these devices increase the cost of the engine and are difficult to match to the primary power source. There is a need to perform this function within an combustion engine. Efficiency has also been increased by use of an external flow of air to cool the engine block. Although each of these concepts helps to increase the efficiency of an combustion engine, there is a need in the art for an engine that combines and improves these elements and other components in an effort to isolate each thermodynamic step of the combustion process to maximize efficiency.

SUMMARY OF THE INVENTION

The present invention provides an external combustion engine and method of operating the external combustion engine comprising means for monitoring power demand of the external combustion engine, means for delivering a flow volume of air to a combustion chamber, means for varying the flow volume of air responsive to the power demand, and means for delivering fuel along with the flow volume of air to the combustion chamber so as to maintain a substantially constant air-to-fuel ratio. The fuel delivery system helps to limit peak temperatures.

The present invention also provides an external combustion engine and method of operating the external combustion engine comprising means for compressing air to an increased pressure, means for admitting the increased pressure air at a constant pressure into a combustion chamber, means for varying the initial volume of the combustion chamber in response to power demand on the external combustion engine, and means for adjusting the volume of the combustion chamber so that the constant pressure may be maintained on admittance of the air. This is accomplished in the preferred embodiment by providing a movable, biased piston that moves into or out of the combustion chamber in response to pressure changes.

The present invention further provides ail external combustion engine comprising means for supplying compressed air to a combustion chamber, means for igniting and expanding the compressed air in the combustion chamber, means for recovering the exhaust heat produced from igniting and expanding the compressed air, means for maintaining the compressed air being supplied at a substantially constant temperature during compression, and means for heating the compressed air before its entry into the combustion chamber with recovered exhaust heat. The temperature during compression is preferably controlled by injecting liquid droplets into the air being compressed.

The present invention further provides an external combustion engine comprising means for accumulating the compressed air at constant pressure before admittance of the compressed air into the combustion chamber. The compressed air may be used for cooling the external combustion engine by recovering the heat which is produced from igniting and expanding the compressed air and then transferred to the metal parts of the block. The flow of air through the block is adjusted so as to maintain proper operating temperature of the combustor and expander and moving parts. In order to minimize the work of compression, a means for maintaining the compressed air at a substantially constant temperature during compression may be supplied. This air may then be heated before its entry into the combustion chamber with recovered heat from the block.

The present invention also provides an external combustion engine comprising a compression chamber for compressing air, wherein the air is compressed in a substantially isothermal manner, a combustion chamber, and a passageway linking the compression chamber to the combustion chamber.

The present invention also provides an external combustion engine and method of operating the external combustion engine comprising means for adjusting the volume of air admitted to a compression chamber and adjusting of the volume of the combustion chamber so that the compression ratio remains constant in response to power demand on the external combustion engine.

The present invention also provides an external combustion engine comprising a combustion chamber for burning the fuel with the air and a passageway connecting the combustion chamber to an expansion chamber. The expansion chamber receives a flow of the hot gas and expands the burned fuel. Catalytic elements are located in the connecting passageway and/or surfaces of the expander and combustor so that the elements can react with the hot gas to reduce pollution. The temperature during reaction is high to maximize the catalytic action and the pressure of the gas is high to minimize volume of the gas. This reduces the catalytic area and minimizes the use of rare elements. A fuel or air injector may also be located in the passageway to inject more fuel into the hot burning gas. This added fuel will react with the hot gas creating a constant temperature expansion cycle. This maximizes power output of the engine by allowing sufficient fuel to react with all of the air at a maximum fuel to air ratio, while keeping the temperature of the gas at a lower level to reduce pollution emissions. The added air will react with the hot burning fuel creating a constant temperature expansion cycle. This maximizes power output of the engine by allowing sufficient air to react with all the fuel at a maximum air to fuel ratio while keeping the temperature of the gas at a lower level to reduce pollution emissions.

The present invention also allows for a longer fuel injection time to reduce the amount of unburned fuel residing in the combustor to minimize flash burning that can cause detonation and peak temperatures when accumulated unburned fuel ignites spontaneously in an external combustion engine.

The present invention also provides an improved lubrication system for a piston and cylinder arrangement. The system comprises a cylinder with cylindrical walls therearound and an inlet passing through one side of the cylinder wall, an outlet passing through the cylindrical wall at a position in axial proximity to the inlet or through a connecting rod, a piston encased in the cylinder and defining a top and a bottom, said top and bottom each comprising a ring for communication with the walls of the cylinder, the piston and the rings positioned such that the inlet and the outlet are located between the top ring and the bottom ring and the inlet and outlet remain between the rings upon movement of the piston up and down in the cylinder. A lubricating material flows into the inlet and out of the outlet such that the material lubricates the piston and the cylinder walls. The material may be oil or a solid lubricant such as graphite. An alternate type of lubrication could be provided by a graphite brush extending from the sides of the piston.

Each of the components and methods of unproved operating efficiency of the systems described above may be used individually or in combination in the present engines to provide an increased efficiency external combustion engine. In addition, the efficiency of the external combustion engine can be increased by use of an expansion chamber located external to the combustion chamber linked by passageway to the combustion chamber. This allows an expansion ratio which is greater than the compression ratio, which further increases the efficiency of the engine. Expansion in this expansion chamber may occur to a pressure below ambient so that the maximum system pressure of the external combustion engine may be reduced. This feature allows the system pans and therefore the entire external combustion engine to be lighter.

Thus, it is an object of the present invention to provide an improved efficiency external combustion engine.

It is a further object of the present invention to provide increased efficiency over the entire operating range of the external combustion engine.

It is a further object of the present invention to provide a compression chamber located external to a combustion chamber.

It is a further object of the present invention to provide a combustion chamber in which compression occurs in a substantially isothermal manner.

It is a further object of the present invention to provide an external combustion engine where the air-to-fuel ratio is kept substantially constant and flow volume of air per revolution varies according to a power demand.

It is a further object of the present invention to provide an external combustion engine with an expansion chamber external to combustion.

It is a further object of the present invention to provide an expansion chamber where expansion may occur to an optimum temperature and pressure level.

It is further an object of the present invention to provide an improved efficiency external combustion engine in which each thermodynamic step is isolated to maximize efficiency.

It is a further object of the present invention to provide an improved efficiency external combustion engine in which a dry lubricant is used to allow elevated operating temperatures of the sliding rings.

It is a further object of the present invention to provide reduced emissions by controlling pressure and temperature spikes in an external combustion engine.

It is a further object of the present invention to provide a smaller area catalytic convertor operating at higher gas temperatures and pressures to minimize the pollution emissions from an external combustion engine.

It is a further object of the present invention to maintain the operating temperature of an engine by utilizing compressed air to remove the heat transferred to the metal block and to use this heat to improve efficiency of an external combustion engine.

It is a further object of the present invention to reclaim exhaust heat and use it in the primary cycle to improve efficiency of an external combustion engine.

It is a further object of the present invention to provide a means to provide multiple fuel use in an external combustion engine.

It is a further object of this invention to provide a means for allowing fuel to be injected into a combustion chamber over a longer period of time to reduce the quantity of unburned fuel accumulating in an external combustion engine and allow extended time for the hot gases to react with catalytic elements.

It is a further object of this invention to provide a constant compression ratio over the operating range of an external combustion engine.

It is a further object of this invention to provide a coordinated operation between the volume of air to be compressed and the volume of the combustor to maintain a nearly constant maximum pressure and temperature over the operating range of an external combustion engine.

It is a further object of this invention to provide a controlled constant temperature expansion cycle in an external combustion engine.

It is a further object of this invention to provide an Unproved lubricating system for an external combustion engine.

It is a further object of this invention to provide extended expansion ratios in a primary engine cycle and to cool exhaust before compressing it back to ambient pressure to provide maximum use of the burned fuel in an external combustion engine.

It is a further object of this invention to maximize the use of a piston moving back and forth in a cylinder of an external combustion engine.

It is a further object of this invention to control the peak temperatures of compression and to allow lower peak temperatures in an external combustion engine.

It is a further object of this invention to contain the heat within the engine block by the use of insulation to provide maximum efficiency in an external combustion engine.

It is a further object of this invention to provide a wide range of control of valve movement to improve operation of an external combustion engine at all speed ranges.

Other objects, features, and advantages of the present invention will become apparent upon consideration of the following detailed description of the invention when taken in conjunction with the drawings and the appended claims.

DETAILED DESCRIPTION OF THE DISCLOSED EMBODIMENTS

Figure 1:
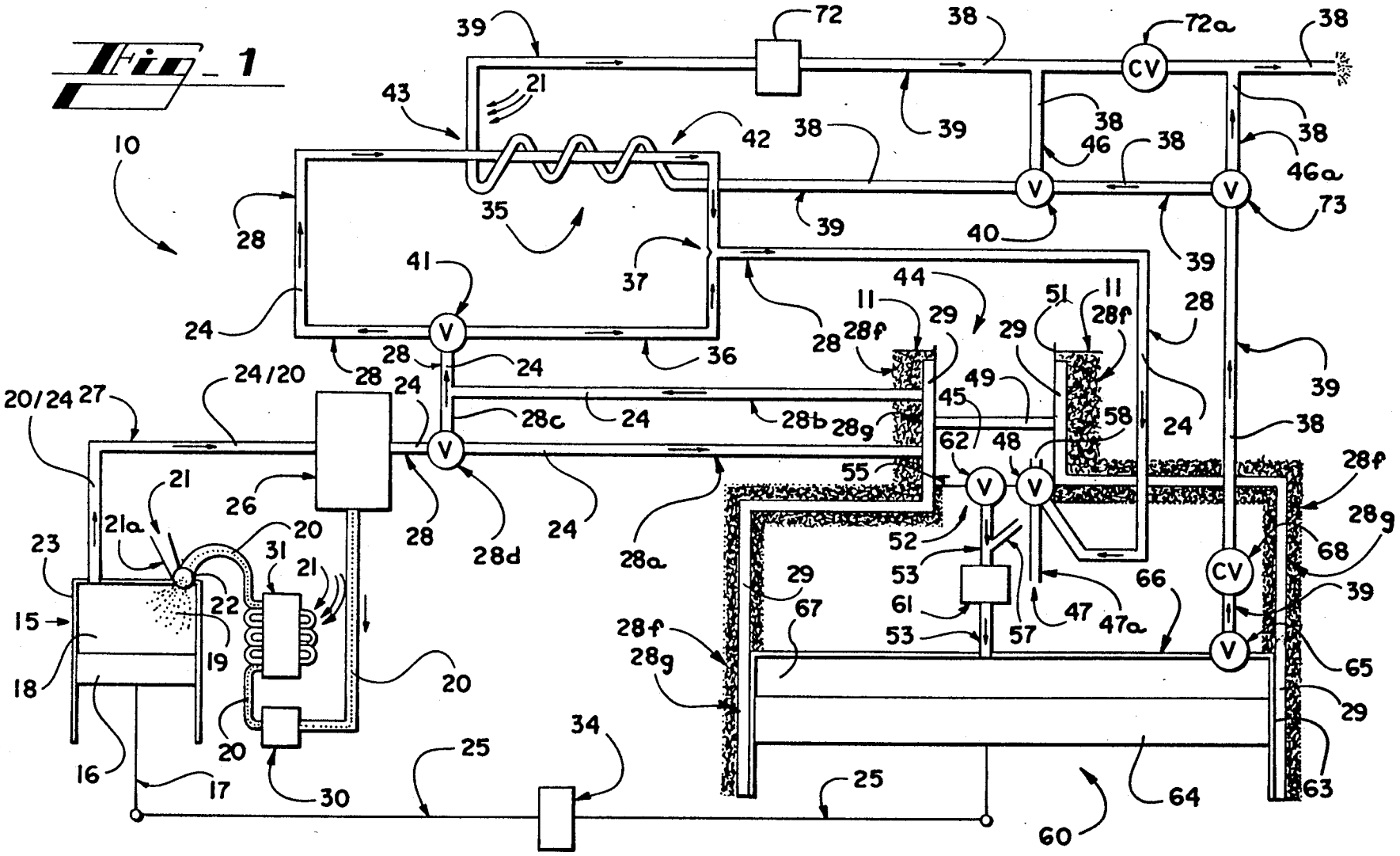
FIG. 1 shows a schematic fluid circuit diagram of an external combustion engine embodying the present invention.

Referring now in more detail to the drawings, in which like reference numerals refer to like parts throughout the several views, FIG. 1 shows a schematic circuit diagram of an external combustion engine apparatus 10 of the present invention. The engine 10 comprises a reaction chamber 44 and an expansion chamber 60 within an insulated block 11. The apparatus 10 uses a constant temperature compressor 15 for supplying compressed air for the apparatus 10 at the lowest work load possible. Compressed air exiting the constant temperature compressor 15 flows to a conditioner storage unit 26 through a passageway 27. Compressed air 24 from the conditioner storage unit 26 flows through a passageway 28 and passes through a block heat control valve 28*d*. Depending on the temperature of the block 11, the air will pass either through a passageway 28*a* and on to cool the block 11 or through another passageway 28*c* to a heat exchanger 35 on the way to a reaction chamber 44 within the insulated block 11. The reaction chamber 44 is connected to a thermal expander 60 by a connecting passage 53. The expander 60 is connected to the compressor 15 by a crankshaft 25. Exhaust 38 flowing through an exhaust passageway 39 from the thermal expander 60 passes through the heat exchanger 35 and out to ambient air.

The compressor 15 is preferably a state-of-the-art air compressor design and could utilize reciprocating, screw or vane type of operation. In the preferred embodiment of the invention, the compressor 15 is driven by the crankshaft 25 connected to the thermal expander 60, as shown in FIG. 1. The crankshaft 25 is connected to a compressor piston 16 by means of a crankshaft connecting rod 17. The piston 16 is housed in a cylinder 23 and with the walls of the cylinder 23 forms a compression chamber 18.

Operation of the compressor 15 is such that ambient air 21 is brought into the compressor 15 through a passageway 21*a*. As the air is brought in, an injector 22 injects a heat absorbing fluid 20 such as oil in the form of droplets 19 into the compressor 15. The compressor 15 is controlled in order to supply a pressure level and supply of outgoing compressed air 24 as needed through an output passageway 27. The compressor 15 may have a regenerative braking cycle, as is explained in U.S. Pat. No. 4,369,623, which is incorporated herein by reference.

Output of the compressor 15 may be controlled in many ways. The speed of the compressor 15 may be controlled to regulate the volume and/or pressure of the compressed air. Other methods of controlling the compressor 15 output include valve timing and adjusting the stroke length of the piston 16 in order to meet current air demands.

The temperature of the compressor 15 may be kept constant by either fluid injection or external air cooling means. The preferred cooling method is fluid injection. Heat absorbing fluid 20 is injected directly into the compression chamber 18, or it can be fumigated into the air 21 on intake, or a combination of each. The object of this process is to create and disperse thousands of heat absorbing droplets 19 in the air 21. These droplets 19 scattered throughout the air 21 will absorb heat to maintain a nearly constant temperature as compression takes place. The timing of the introduction of the cooling fluid 20 is optimized to insure good droplet 19 scatter as the air 21 is being compressed. Sufficient droplets 19 are added to the residual fluid 20 in the chamber 18 to create a fluid filler at the end of the compression stroke. This fluid 20 fills all spaces at the end of the stroke to insure that all air is ejected from the compressor 15. Part of this fluid 20 is ejected from the compressor 15 along with the compressed air 24 into the passageway 27; thus the losses generally occurring due to compressor clearance requirements and production tolerances are eliminated.

Figure 2:
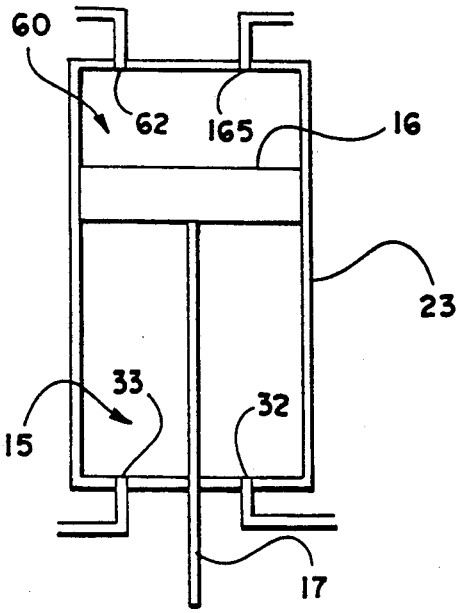
FIG. 2 shows a schematic diagram of an embodiment of the compressor and thermal expander of the present invention wherein the two components share the same piston and cylinder.

Although the compressor 15 could be a stand-alone device, an embodiment of the compressor 15 shown in FIG. 2 depicts a reciprocating piston type of operation with the compressor 15 and the thermal expander 60 sharing a single cylinder 23 and the same piston 16. The piston 16 separates the compressor 15 from the thermal expander 60 and is connected to a crank shaft connecting rod 17. Operation of this design works so that as the piston 16 is moving away from the side of the cylinder 23 containing the compressor 15, the compressor 15 is in the intake mode, while the thermal expander 60 is in the exhaust mode. When the direction of the piston 16 reverses, the thermal expander 60 is in the expansion mode, while the compressor 15 is in the compression mode. Operation and design of the thermal expander 60 is explained in further detail below.

Compressed air 24 output from the compressor 15 passes through the passageway 27 and may either go straight to the reaction chamber 44 where combustion occurs (not shown) or to the conditioner storage unit 26. The conditioner storage unit 26 receives the mixture of compressed air 24 and cooling fluid 20 from the constant temperature compressor 15. The conditioner storage unit 26 then separates out the cooling fluid 20 from the compressed air 24 in a manner similar to existing oil bath air filters. The pressurized air 24 then flows to the reaction chamber 44 through the passageway 28. The cooling fluid 20 is removed from the conditioner storage unit 26 by a circulating pump 30. The cooling fluid 20 will then flow through a high or low pressure radiator 31 where the heat the cooling fluid 20 absorbed during compression is removed by ambient air 21. The cooling fluid 20 then flows to the injector 22 of the constant temperature compressor 15 to be used on following compression cycles.

Figure 3:
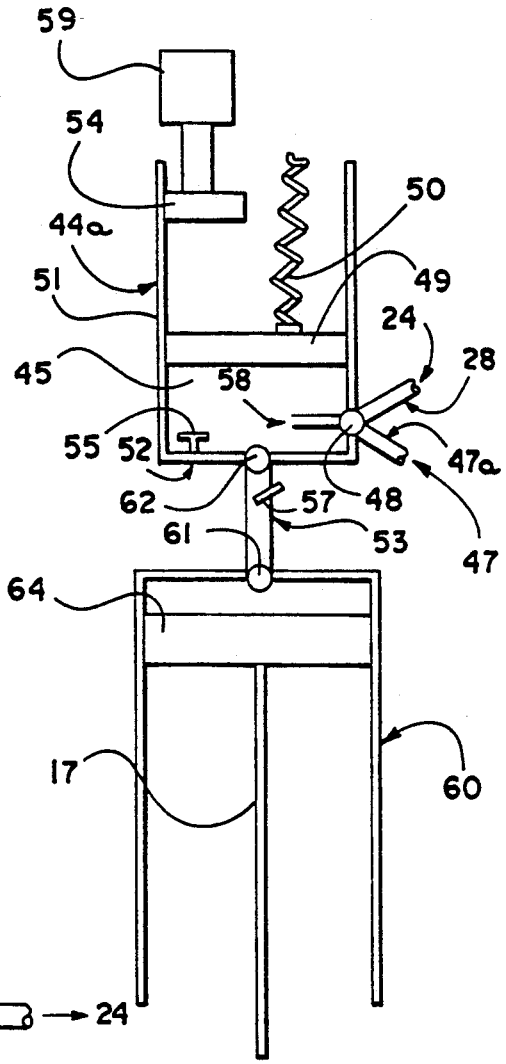
FIG. 3 shows a schematic diagram of the constant ratio compressor of the present invention.

A variation of the preferred embodiment of the present invention shown in FIG. 3 changes the operation of the constant temperature compressor 15 to polytropic; that is, the air is not compressed isothermally and the conditioner storage unit 26 is not used. The structure utilizes a constant ratio compressor 15*a*. The crank shaft 25 operates a piston 16*a* in the constant ratio compressor 15*a* cylinder 23*a*. Input air 21 to the compressor 15*a* is controlled by an adjustable input valve 32. The valve 32 controls the amount of air allowed to flow into the cylinder 23*a* and is adjusted according to power demand. A reed poppet valve 33 allows the air to enter the cylinder 23*a* but prevents it from being forced out of the cylinder 23*a*.

An alternative embodiment of the constant ratio compressor 15*a* could utilize a reciprocating piston type of operation with the compressor 15*a* and the thermal expander 60 sharing a single cylinder 23 and a single piston 16. The structure of this two-stroke design engine is similar to the design in FIG. 2.

In the constant ratio compressor 15*a*, the output of the compressed air 24 is controlled by the amount of input air 21 to the compressor 15*a*. Instead of setting a determined pressure to be maintained in the conditioner storage unit 26 that in turn feeds the pressurized air into the reaction chamber 44, the constant ratio compressor 15*a* adjusts output of air 24 volume according to power needs, and that air 24 flows straight to the reaction chamber 44. The volume of the reaction chamber 44 is adjusted, as described below, in coordination with the volume of the air 24 entering the constant ratio compressor 15*a* to maintain a constant compression ratio over the load range of the engine.

The operation of the constant ratio compressor 15*a* is such that when the piston 16*a* is withdrawn from the cylinder 23*a*, ambient air 21 is sucked into the cylinder 23*a* through the input valve 32. When the crank shaft 25 causes the piston 16*a* to move into the cylinder 23*a*, the trapped air 21 is compressed and flows into the reaction chamber 44 as compressed air 24. Thus, the stroke of the piston 16*a* remains the same; the amount of ambient air 21 allowed into the compression chamber 18 and the adjustment of the volume of the reaction chamber 44 determines the pressure of the compressed air 24 that enters the reaction chamber 44. An alternative to the air intake volume control method could be the use of a swashplate (not pictured) that controls the piston 16*a* stroke length.

In the preferred embodiment of the present invention the combustion chamber 44 is located within the block 11, as is shown in FIG. 1. An outer wall 28*g* on the block 11 forms a plurality of air passageways 29 surrounding the block 11 to provide cooling for the combustion chamber 44 and expander 60. The outer wall 28*g* is preferably covered with insulation 28*f* During operation of the engine 10, pressurized air 24 flows from the conditioner storage unit 26 to the block heat valve 28*d*. The block heat control valve 28*d* is controlled by a block heat sensor (not shown). The compressed air flow 24 will be directed by the block heat control valve 28*d* such that if the block 11 is below a set temperature, all of the flow of air 24 will be directed to an air ratio valve 41 through the passage 28*c*. Operation of the air ratio valve 41 is explained in detail below. However, if the temperature of the block 11 is too high, the block heat control valve 28*d* will direct the flow of air 24 to the passageways 29 in block 11. The air passages 29 in the block 11 cause the air 24 to pass over heat removing fins (not shown) in the block 11 and remove heat transferred to the metal parts of block 11. The flow of air 24 starts at the low temperature areas and is directed to pass through the block 11 to the high temperature areas and exit the block 11 through a passageway 28*b* to the passageway 28*c*. In this manner, the block 11 temperature is maintained at the proper operating temperature and the otherwise wasted heat is available for use in the reaction chamber 44. Heat exchanger 35 and passageways 28*b*, 28 and 39 are insulated to contain useful heat.

Referring again to FIG. 1, in the preferred embodiment of the present invention, the pressurized air 24 passes through the heat exchanger 35 before flowing to the reaction chamber 44. The heat exchanger 35 operates such that hot exhaust 38 from the expander 60 enters one end 42 of the heat exchanger 35 and the compressed air 24 enters the opposite end 43. The hot exhaust 38 flows through the heat exchanger 35 in a manner that causes the temperature of the heat exchanger 35 to rise. The exhaust-entry end 42 of the heat exchanger 35 becomes extremely hot, whereas, the compressed air entry end 43 is at a much reduced temperature. The output of the heat exchanger 35 is cooled exhaust gas 38 and hot compressed air 24.

The heat exchanger 35 design is selected to improve fuel economy of the engine at the horsepower level normally used. An exhaust ratio valve 40 may be used to direct some of the exhaust 38 around the heat exchanger 35 so that the size of the heat exchanger 35 may be determined by a reduced horsepower exhaust gas flow volume. The exhaust ratio valve 40 is located in the exhaust passageway 39 at the exhaust entry end 42 of the heat exchanger 35. The exhaust ratio valve 40 controls the temperature added to the compressed air 24. The valve 40 directs some of the exhaust gas 38 around the heat exchanger 35 through a bypass passageway 46. The remaining exhaust gas 38 flows through the heat exchanger 35. Since some of the hot exhaust gas 38 is not available to heat the compressed air 24, a lower temperature compressed air 24 flows out of the heat exchanger 35. Heat control for the air 24 is similarly provided by a compressed air ratio valve 41. The compressed air ratio valve 41 is located on the passageway 28 at the compressed air entry end 43 of the heat exchanger 35. Compressed air 24 may be directed by the compressed air ratio valve 41 through the heat exchanger 35 or may be directed through a bypass passageway 36 around the heat exchanger 35. The cooled compressed air 24 and the bypassed compressed air 24 are recombined at junction 37 on FIG. 1 to form a controlled temperature compressed air 24 to be used for combustion.

The preheated compressed air 24 flows to the reaction chamber 44 through the passageway 28 where it is trapped in a chamber cavity 45 of a combustion cylinder 51. Fuel 47 is added through a passageway 47*a*. One end 52 of the cylinder 51 is closed off completely except when an expansion valve 62 opens to the connecting passageway 53 between the reaction chamber 44 and the thermal expander 60. A port 58 is located at the end 52 of the cylinder 51 for entry of compressed air 24 and fuel 47. A control valve 48 is located at the entry port 58 for regulating the amount of air 24 and fuel 47 mixture to enter the chamber cavity 45. An igniter 55 such as a spark or glow plug for combusting the air 24 and fuel 47 mixture is also located at the end 52 of the cylinder 51. The cylinder 51 contains a piston 49, which with the walls of the cylinder 51 defines the chamber cavity 45. The cylinder 51 and the piston 49 of the present invention could use the latest ceramic technology to limit heat losses. The ceramic coatings may contain catalytic elements to form part of a high pressure catalytic converter. Their configuration reduces surface area and limits "squish" effects and provides turbulent movement of the air to insure complete mixing of the reactants. A servo mechanism 59 is mounted at the opposite end of the cylinder 51 and is connected to the piston 49 via the spring 56 or the adjustable stop 54, depending on the configuration of reaction chamber 44, as explained below in connection with FIGS. 4–8.

There are three possible process configurations for the reaction chamber 44: (1) constant volume, (2) constant pressure, and (3) constant volume/pressure. "constant volume" and "constant pressure" refer to operation during combustion. That is, "constant volume" refers to a process where volume remains constant while pressure and temperature increase during combustion; and "constant pressure" refers to a process where pressure remains constant while volume and temperature increase during combustion. "Constant volume/pressure" refers to a process where combustion occurs first at constant volume, then at constant pressure.

Figure 4:
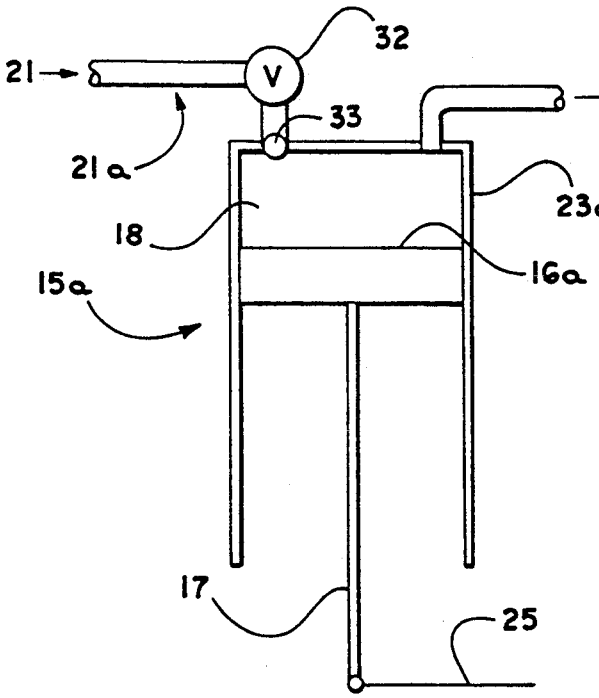
FIG. 4 shows a schematic diagram of a constant volume reaction chamber for use in the external combustion engine of FIG. 1.

The structure of a constant volume reaction chamber 44*a* is depicted in FIG. 4. The piston 49 of the constant volume reaction chamber 44*a* is associated with a retarding spring 50. The spring 50 could consist of a coil spring or hydraulic or air pressure cylinders and associated valving of current design. An adjustable stop 54 is located at a place outside of the piston 49 in the cylinder 51. The adjustable stop 54 is used to set the amount of air 24 allowed into the chamber 45. The position of the stop 54 is determined by the needed power output of the external combustion engine 10. This relationship may be determined by the servo 59, in this case connected to the stop 54. The inputs to the constant volume reaction chamber 44*a* are heated, compressed air 24 and fuel 47 which are admitted through inlet port 58. The control inputs are the control valve 48, the retarding spring 50 and the adjustable stop 54.

During operation of the constant volume reaction chamber 44*a*, the control valve 48 opens to allow compressed air 24 and fuel 47 to flow into the reaction chamber cavity 45. This action forces the reaction piston 49 away from the end 52 of the cylinder 51, exerting force on the spring 50. FIG. 4 shows the piston 49 at a point about midway between its starting point and the adjustable stop 54 with the spring 50 partially compressed. The force of spring 50 is somewhat less than the force of the compressed air 24 on the piston 49.

The mixture of compressed air 24 and fuel 47 move the piston 49, until the piston 49 reaches the adjustable stop 54. At this time piston 49 is stopped from moving which in turn prevents further air 24 and fuel 47 from entering the chamber 45 and defines the volume of the chamber 45 for the subsequent combustion. Thus, the amount of air 24 to be used during each power stroke is controlled by the position of the stop 54 and is constant for a given level of requested power. When the adjustable stop 54 is reached, the control valve 48 is closed trapping the mixture of air 24 and fuel 47 in the chamber 45. The igniter 55 is used to insure the start of combustion. The fuel 47 reacts with the compressed air 24, raising the temperature and pressure of the mixture. The adjustable stop 54 holds the volume constant during this process.

When the thermal expander 60 is in position to receive the hot gas, the expansion valve 62 is opened. This allows the hot gas to flow through the connecting passage 53 into a catalytic convertor 61. An alternative catalytic converter 61 could consist of all wall areas of the combustor 44 and expander 60. As the high temperature, high pressure gas flows through the catalytic convertor 61, it passes over the rare earth elements and causes a chemical change in the hot gas to reduce pollution emissions (known art). When the hot gas exits the catalytic convertor 61, it continues to flow through connecting passage 53 into the thermal expander 60. At a point during this process, the pressure in the constant volume reaction chamber 44 drops below the compressed air 24 pressure level. When this point is reached, the spring 50 starts to force the piston 49 away from the adjustable stop 54, decreasing the size of the chamber cavity 45. This action causes the remaining hot gas to be forced into the thermal expander 60 in a constant pressure process. When the piston 49 reaches its inward stopping point and the gas has emptied out of the chamber, the valve 62 is closed in preparation for the next reaction process within the constant volume reaction chamber 44*a*.

Figure 5:
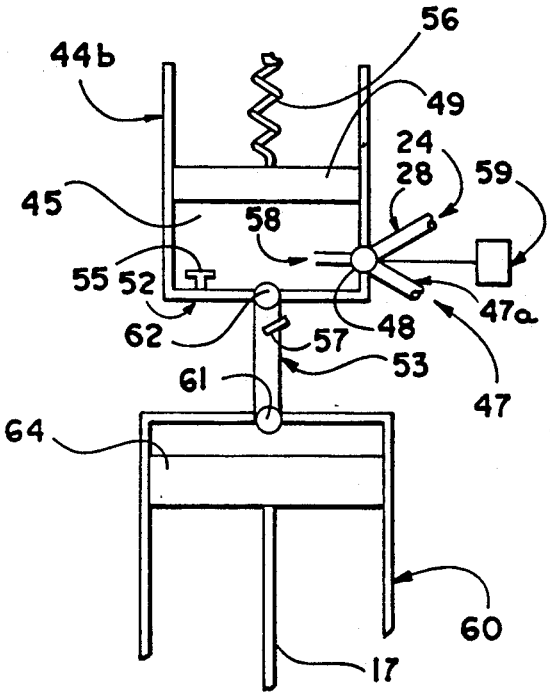
FIG. 5 shows a schematic diagram of a constant pressure reaction chamber for use in the external combustion engine of FIG. 1.

The structure of the constant pressure reaction chamber 44*b* is depicted in FIG. 5. The piston 49 of the constant pressure reaction chamber 44*b* is associated with the spring 56 and when fully extended holds piston 49 near the bottom of the chamber 45, compressing the residual gas. The servo 59 determines the valve 48 closing control point in response to power demands. This positioning is done before the cycle is started.

The operation of the constant pressure reaction chamber 44*b* is basically the same as that of the constant volume reaction chamber 44*a* with a few changes. Input pressure of the compressed air 24 has been increased to the maximum pressure of the external combustion engine 10. The control valve 48 opens and closes to allow the contact amount of air 24 and fuel 47 into the chamber 45, which causes a force on the piston 49 and the spring 56. The spring 56 is designed to exert an essentially equal opposite force on the piston 49, and limits air flow as spring 56 is compressed. When the control valve 48 is closed, no further air 24 or fuel 47 is injected. As combustion occurs, the temperature and volume of the air is increased. The spring 56 allows the piston 49 to move as combustion occurs, thus maintaining a constant pressure in the chamber cavity 45.

When the expansion process is to occur, the valve 62 opens allowing the hot gas to flow into the thermal expander 60. When the hot gas starts to flow out of the chamber 45, the spring 56 causes the piston 49 to move forcing the hot gas out of chamber 45 in a constant pressure process. At the end of the expulsion stroke, the valve 62 is closed, and the residual gas is compressed, readying the constant pressure reaction chamber 44*b* for the next cycle.

Figure 6:
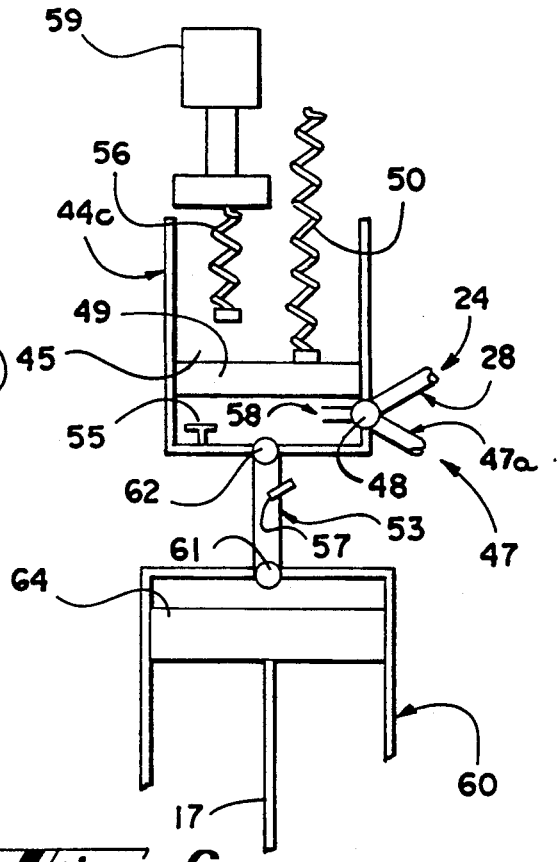
FIG. 6 shows a schematic diagram of a constant volume/pressure reaction chamber for use in the external combustion engine of FIG. 1 at the beginning of the combustion cycle.
Figure 7:
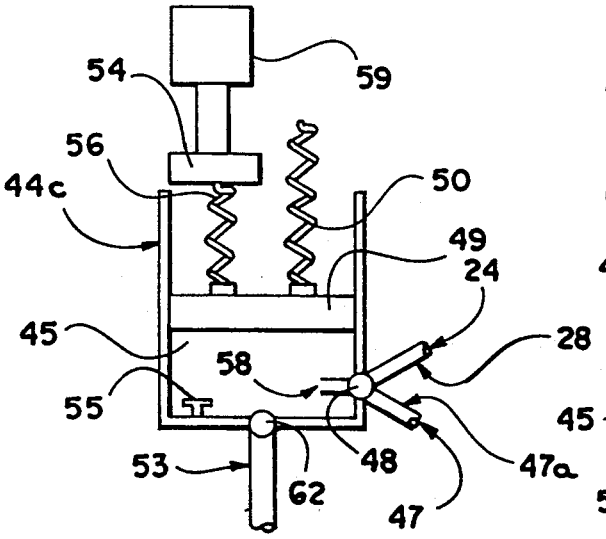
FIG. 7 shows a schematic diagram of the constant volume/pressure reaction chamber of FIG. 6 at a stage just before combustion of air and fuel mixture.
Figure 8:
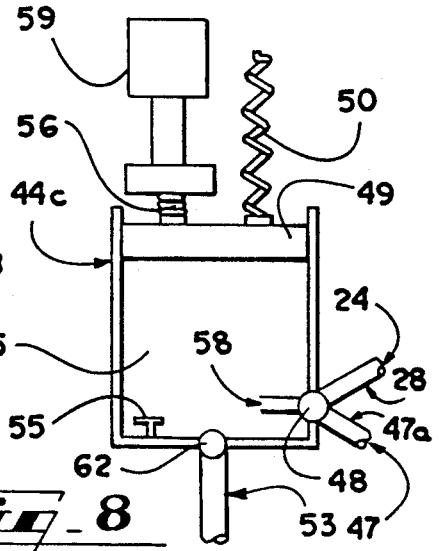
FIG. 8 shows a schematic diagram of the constant volume/pressure reaction chamber of FIG. 6 at a stage just after combustion of the air and fuel mixture.

The constant volume/pressure reaction chamber 44*c* shown in FIGS. 6–8 utilizes and combines features of the previously described constant volume reaction chamber 44*a* and constant pressure reaction chamber 44*b*. The constant volume/pressure reaction chamber 44*c* utilizes both the spring 50 and the spring 56, and the servo 59 is associated with the spring 56. The spring 50 has contact with the piston 49 and when fully extended holds it near the bottom of cavity 45 compressing the residual gas before compressed air 24 and fuel 47 enter the chamber cavity 45 as is shown in FIG. 6. The incoming air initially compresses the spring 50. Before the air 24 and fuel 47 are inserted into the chamber, the spring 56 is not in contact with the piston 49 as is shown in FIG. 6. Instead, the spring 56 performs a function similar to the adjustable stop 54 of the constant volume reaction chamber 44*a* on the entry of air 24; that is, air 24 continues to enter the cavity 45 while compressing spring 50 until the piston comes in contact with spring 56 as is shown in FIG. 7. The initial position of the stronger spring 56 is determined by the servo 59 in response to power demand. Once the valve 48 is opened to allow air 24 and fuel 47 to enter the cavity 45, the air 24 forces the piston 49 to move and compress the spring 50. The second spring 56 stops the movement of the piston 49 due to its higher spring constant and limits the amount of air admitted to the cavity 45. When piston 49 stops, control valve 48 is closed trapping the air 24 in chamber 45.

At this point the igniter 55 causes the fuel 47 and air 24 to burn causing an increase in temperature and pressure. The mixture of air 24 and fuel 47 burns at constant volume until the pressure of the gas increases to a point where it overcomes the force of the spring 56. Then the piston 49 starts to move again, allowing the volume of the chamber 45 to increase in a constant pressure process. When all of the fuel 47 has burned, the piston 49 stops moving since the pressure is balanced with the spring 56. This position is depicted by FIG. 8. When the thermal expander 60 is in the position to receive the hot gas, the valve 62 is opened. The gas in chamber 45 then begins to flow into the thermal expander 60 under the force of the spring 56.

The gas first exits the constant volume/pressure reaction chamber 44*c* in a constant pressure process, as the spring 56 causes the piston 49 to force the hot gas out of the chamber cavity 45. When the piston 49 reaches the fully extended position of the spring 56 corresponding to the position in FIG. 7, the piston 49 stops moving. A stage of expansion occurs in a constant volume process from the high pressure of combustion to the lower pressure of compression which is equal to the force of the spring 50. When the pressure of the spring 50 is reached, the spring 50 will exert a force on the piston 49 and start it moving again. This action causes all of the remaining hot gas to be expelled from chamber 45 in a second constant pressure process. Near the end of a stroke of the piston 49, the valve 62 is closed, and the residual gas is compressed to the pressure of air 24 preparing the constant volume/pressure reaction chamber 44*c* for the next cycle.

Figure 21:
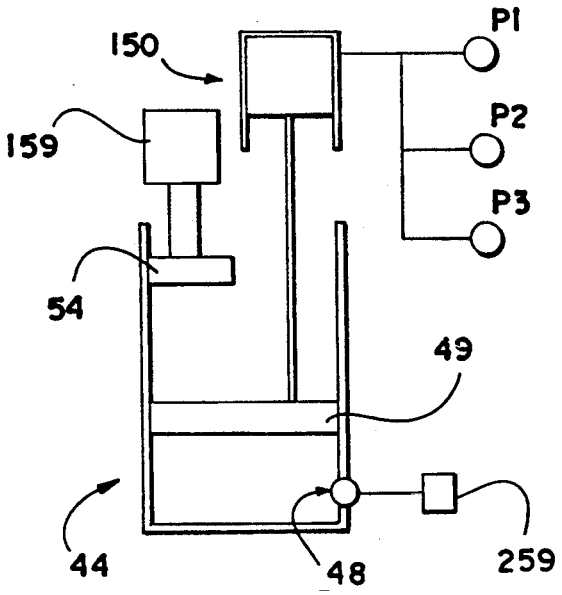
FIG. 21 shows a piston and cylinder arrangement for the present invention which is capable of the operations of the reaction chambers of FIGS. 4–6.

In order to decrease the pressure of the system, spring 50 or spring 56 or even an additional spring (not shown) may be used to compress the air in the combustion chamber 44 after all air is admitted. In addition, if the spring force used consists of hydraulic or air pressure and associated valving, different inputs will allow different operations in the same cylinder. An example of this type of operation is shown in FIG. 21. In FIG. 21, a cylinder 150 using hydraulic or air pressure and associated valving controls the operation of the piston 49 of the combustion chamber 44. The cylinder 150 has three different pressure inputs: P1, P2, and P3. The chamber 44 may also include an adjustable stop 54, such as was discussed in describing the constant volume reaction chamber 44*a*. The adjustable stop 54 is attached to a servo 159.

The operation of this system is as follows. If only input P1 is used, operation of the combustion chamber 44 is similar to that of the constant volume reaction chamber 44*a*. That is, the pressure P1 may be set to cause the cylinder 150 to act just as spring 50 shown in FIG. 4. Thus, operation may occur in the combustion chamber 44 just as in the constant volume reaction chamber 44*a* by using the cylinder 150 with input P1 in conjunction with the adjustable stop 54 and servo 159. In contrast, if only input P2 is used, the operation may be similar to that of the constant pressure reaction chamber 44*b*. That is, the pressure P2 may be set to cause the operation of the cylinder 150 to be similar to that of the spring 56, discussed when describing the constant pressure reaction chamber 44*b*. If this operation is used, a servo 259 is attached to the valve 48 so that air input may be stopped at the proper time. Inputs P1 and P2 may be used together to perform a cycle similar to that performed by the constant volume/pressure reaction chamber 44*c*, discussed earlier.

In order to decrease the compression of the entire engine 10, input P3 may be used in conjunction with either input P1 or input P2 or both to compress air in the chamber 44 once that air is admitted. For example, if the pressure of the system is currently 500 psi, and combustion needs to occur at 1,000 psi to increase efficiency, input P3 may be used to increase pressure inside the chamber 45 once air is admitted. The input P3 is not added to the cylinder 150 until just before combustion. Thus, if the air in the chamber 44 is at 500 psi after the valve 48 is closed, pressure exerted from the cylinder 150 by means of the input P3 compresses the air to an increased pressure (for example, 1,000 psi) before combustion. Use of this type of system allows a lower maximum pressure for the system and thus lighter parts for the engine 10.

In the previous discussion of the operation of combustion chambers 44*a*, 44*b*, and 44*c*, the air 24 was considered to be compressed to a pressure which caused the air to flow into the combustion chambers. In an alternate embodiment utilizing a constant ratio compressor 15*a*, the volume of the compression chamber 18 is coordinated with the volume of the combustion chamber 44*a*, 44*b* or 44*c*. In this operation an amount of air would be inducted into the compression chamber 18. The amount of this air would be determined by the volume adjustment of the combustion chamber 44*a*, 44*b* or 44*c* in such a way that the same compression ratio could be maintained for all power levels of the external combustion engine 10 when the compression chamber 18 forces the air to flow directly into the combustion chambers 44*a*, 44*b* or 44*c*. The combustion chambers 44*a* and 44*c*, would not contain the spring 50, but instead would start with an empty reaction chamber cavity 45.

From the previous discussion, it is clear that the reaction process is not directly tied to the thermal expansion operation. The independence of the two processes allows the reaction to take place independently in the reaction chamber 44 while the thermal expander 60 is completing the previous cycle.

To increase power output of the external combustion engine 10, an afterburn fuel injector 57 can be used. The afterburn fuel injector 57 may be added to the connecting passage 53 between the reaction chamber 44 and the catalytic convertor 61 as shown in FIG. 1. The fuel injector 57 injects fuel 47 into the hot gas flowing out of the chamber 45 through the passage 53. The added fuel 47 would burn to provide an added constant temperature expansion process as the hot gas fills the thermal expander 60 in the first part of expansion. An alternative to the afterburn fuel injector 57 would be an afterburn air injector also located in passage 53. This would allow the extra fuel 47 in a fuel-rich mixture to combust and raise the temperature.

Figure 22:
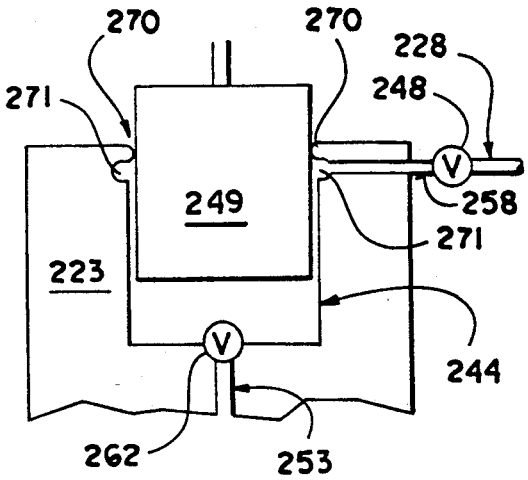
FIG. 22 shows an air-cooling system for a piston and cylinder arrangement for the present invention.

An alternative embodiment for the air injector is shown in FIG. 22. In this embodiment of combustion chamber 244, a piston 249 is journalled inside a cylinder 223. A seal 270 protruding from the cylinder wall surrounds the piston 249 and prevents radial movement of the piston 249. An annular cavity 271 formed in the cylinder wall is located just below the seal 270 in the drawing. A small amount of clearance exists between the cylinder 223 and the part of the piston 249 extending below the cavity 271 (the inserted portion of the piston), the purpose of which is described below. Air input is provided by a passage 228 through the cylinder wall and is controlled by a valve 248. Air flowing through the valve 248 is directed through an inlet 258 to the annular cavity 271. The operation of this air injection system is as follows. The valve 248 opens and air is directed through an inlet 258 to the annular cavity 271. The air then flows from the annular ting 271 down the sides of the piston 249 in the form of a cylindrical sheet. This action allows a number of advantages, including cooling of the piston 249 and cylinder walls, possible air injection for a fuel rich mixture, and blowout of combusted gases after combustion.

In addition, the set up of the chamber 244 may be such that both air and fuel enter the valve 248 and no other input valves are needed.

The thermal expander 60 of the preferred embodiment is best depicted by FIG. 1. The thermal expander 60 of the present invention could use state-of-the-art heat engine design. Its purpose is to receive the hot, high pressure gas from the reaction chamber 44 and expand it to provide a work output. The thermal expander 60 could utilize high pressure expanders such as free piston, reciprocating piston, rotary vane or Wankel designs. In the preferred embodiment of the thermal expander 60, a cylinder 63 defines an expansion chamber. One end 66 of the cylinder 63 is closed off completely except when the expansion valve 62 opens to the connecting passageway 53 between the reaction chamber 44 and the thermal expander 60. This end 66 of the cylinder also includes an exhaust valve 65 which leads to an exhaust passageway 39. The cylinder 63 contains a piston 64, which with the walls of the cylinder 63 forms an expansion cavity 67. The thermal expander 60 could use the latest ceramic technology on the inside walls and head of the cylinder 63 and top of the piston 64. The layer of ceramic materials may contain catalytic elements to react with the hot gases to reduce air pollution. The expander cavity 67 has zero volume at the beginning of the expansion stroke, that is, when the piston 64 is at top dead center.

In the preferred operation of the thermal expander 60, the input of hot gas from the reaction chamber 44 is controlled by the valve 62. When the valve 62 is opened, the hot gas in the reaction chamber 44 can flow into the thermal expander 60. The thermal expander 60 volume is preferably much greater than the volume of the reaction chamber 44. Since the fuel does not start to burn in the thermal expander 60, "squish" and other detrimental effects in present external combustion engines do not occur. Therefore, the design could be such that there is a very large piston 64 head area to stroke length ratio. This would allow short strokes and, because of the large surface area of the piston, significant expansion ratios between volumes of the reaction chamber 44 and the thermal expander 60.

This feature will reduce the sliding distance of the piston rings and the metal area exposed to the hot gases to lower losses.

During the exhaust stroke, the thermal expander piston 64 forces the spent gas through the exhaust valve 65. Due to the large head area, it should be understood that many small valves could be used to increase the exhaust area to reduce flow losses. During low power output, the expansion ratio could cause the gas pressure in the thermal expander 60 to drop below ambient as explained below. To prevent ambient air 21 backfeeding into the thermal expander 60, a reverse exhaust check valve 68 may be added to work in harmony with exhaust valve 65.

Just prior to the thermal expander 60 reaching its final exhaust point (top dead center), the exhaust valve 65 is closed, and the final movement of the thermal expander piston 64 compresses the remaining exhaust up to a pressure equal to that of the hot gas in the reaction chamber 44 to eliminate blowdown losses. Timing of the closure of the exhaust valve 65 could be determined by the exhaust gas 38 pressure. The compression pressure also causes the control valve 62 to lift off of its seat. This feature allows a wide variance in exhaust pressure without blowdown losses. Due to the pressure equalization on both sides of the control valve 62, very little force is required to open it to the maximum lift position at the start of the next stroke.

In order to expand the hot gas to convert as much heat to work as possible, a sub-atmospheric pressure concept is presented. This technique is used to further expand the hot gas in the thermal expander 60 at minimum power levels. The exhaust gas 38 is expanded to a pressure below ambient, but still contains a high heat content. This concept is utilized by selection of the relative volumes of the combustion chamber cavity 44 and the expansion cavity 67. At low power, a small volume of air and gas is used in the combustion cavity 44 because of small power demands. However, the expansion cavity 67 remains the same on each of its strokes. To fill the large volume of the expansion cavity 67 with the small volume of burning gas coming from the combustion chamber cavity 44, the expansion occurs to a pressure level below ambient. At high power, a larger amount of air and fuel is combusted in the reaction chamber 44. When this large volume of air flows into the expansion cavity 67, expansion terminates at a pressure above ambient.

An exhaust check valve **72*a* is employed to keep ambient air from backflowing into the exhaust passageway 39, when the pressure of gas 38 therein is below ambient. A bypass valve 73 directs exhaust 38 through the heat exchanger 35 to an exhaust compressor 72. The bypass valve 73 is located on the exhaust passageway 39 between the thermal expander 60 and the heat exchanger 35. When exhaust 38 is above ambient pressure, it may be directed through a bypass passageway 46*a* straight to ambient air 21**.

During low power levels, the bypass valve 73 is closed. This causes all of the exhaust gas 38 to flow to the heat exchanger 35 where it transfers heat to the compressed air 24 flowing through the heat exchanger 35 in the appropriate direction. The temperature of the hot gas 38 can be further reduced by ambient air 21 flowing through a separate section of the heat exchanger 35 as shown by the arrows in FIG. 1. Output of the heat exchanger 35 is hot compressed air 24 that can be used in the combustion process and cooled exhaust gas 38 at subatmospheric pressure. The exhaust compressor 72 is used to compress exhaust 38 to ambient releasing the gas to the atmosphere. When heat is removed from the exhaust gas 38 by the heat exchanger 35, the volume of the gas 38 is reduced. This lessens the work load of the exhaust compressor 72 to a minimum value. The expansion of the thermal expander 60 to subatmospheric pressure produces considerably more work output than the work of the exhaust compressor 72 needed to compress the cooled gas to ambient.

During high output levels, the pressure of the exhaust gas 38 increases due to reduced expansion ratios. During this operation, the bypass valve 73 is opened. This allows most of the exhaust gas 38 to flow through the bypass valve 73 to the bypass passageway 46*a* and exit as exhaust gas 38 to the atmosphere at or above ambient pressure. This feature allows the exhaust compressor 72 to be sized for use only at specific low output levels to reduce its overall size. The advantage of the subatmospheric pressure expansion at low power levels is that expansion of high pressure gas input to the thermal expander 60 can be extended or the maximum system pressure may be lowered to produce the same quantity of work per pound of air. This feature would allow the system parts to be much lighter.

Figure 9:
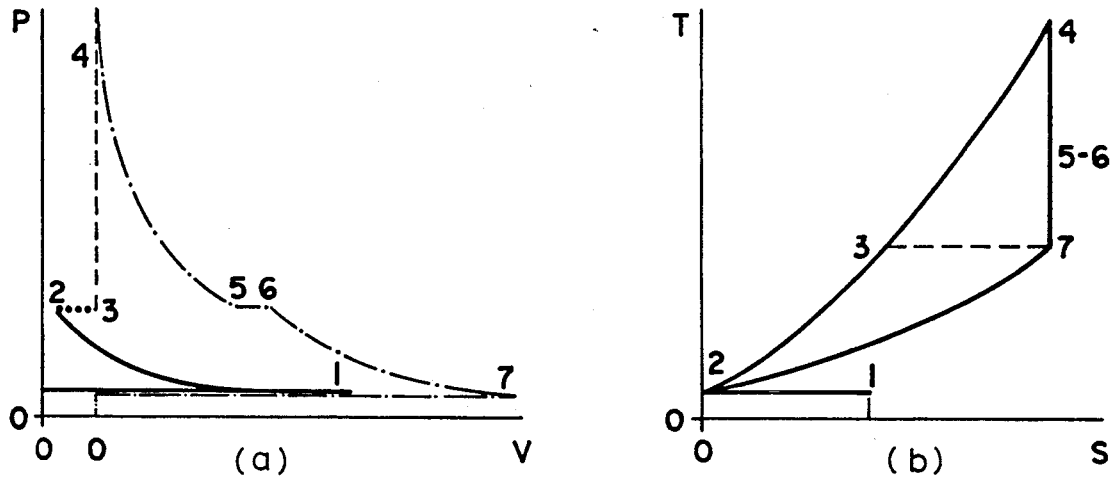
FIGS. 9*a* and 9*b* show pressure-volume and temperature-entropy graphs for the engine cycle of the present invention comprising the constant volume reaction chamber of FIG. 4.
Figure 10:
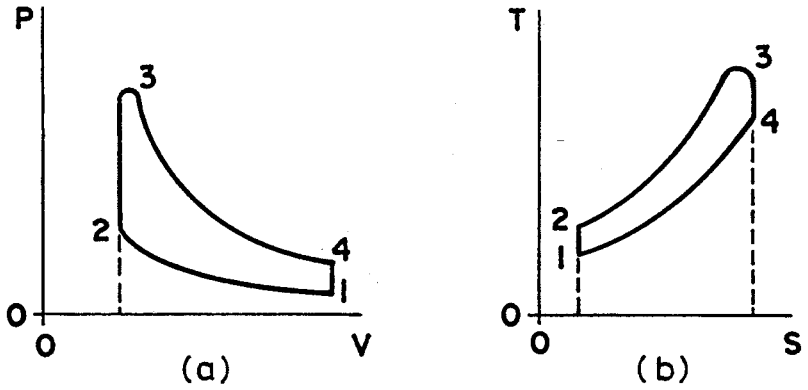
Fig. 10 (PRIOR ART)
FIGS. 10*a* and 10*b* show pressure-volume and temperature-entropy graphs for a prior art Otto engine cycle.

A cycle using a constant volume reaction chamber 44*a* is similar in operation to a conventional Otto cycle. However, significant differences are postulated in the present invention that dramatically increase efficiency over that of the conventional Otto engine. FIGS. 9 and 10 depict the pressure-volume (P-V) and the temperature-entropy (T-S) curves for the cycle of an engine using a constant volume reaction chamber 44*a* and an Otto cycle, respectively. The advantages over the Otto cycle of each step of the combustion process are explained below.

On the P-V graph of FIG. 9(*a*), two zero volume states are shown. The one on the left side is for the constant temperature compressor 15, a zero volume clearance device. The one on the right is for the thermal expander 60, also a zero clearance device.

In order to distinguish the operation of each device in the cycle, the figure has been coded by different line characteristics. A solid line represents the operation of the constant temperature compressor 15, a an dotted line represents the operation of the heat exchanger 35, a dashed line represents the operation of the constant volume reaction chamber 44*a*, and a dash-dot combination represents the operation of the thermal expander 60. Where processes seem to overlap due to zero clearance reference, the lines are seen to run parallel to each other to distinguish the stopping and starting points of the appropriate device.

The efficiency of external combustion engines is directly related to the work developed by burning fuel less work losses of compression, divided by the fuel used. Therefore, it is advantageous to minimize the work of compression. It is well known in compressor art that a constant temperature compressor requires the least amount of work for compression. Therefore, the preferred present invention utilizes this principle. The T-S diagram in FIG. 10 shows that the Otto cycle utilizes a constant entropy process which causes the temperature of the air to increase as it is being compressed as is shown from line 1–2. This is a process of maximum work. In contrast, the T-S diagram for the engine utilizing a constant volume reaction chamber 44*a* utilizes a constant temperature compression process, a process of minimum work. Process 0–1 is the induction work done by the air as it flows into the compressor, and process 1–2 is the constant temperature compression process.

In order to maximize efficiency, it is essential to keep all of the heat within a cycle. The heat exchanger 35 and block heat removal of the present invention takes advantage of this concept. Present day Otto engines do not utilize the advantage of the heat exchanger 35 or the use of block heat of the present invention. The heat exchanger 35 adds an initial heating process shown in FIG. 9(*a*) and 9(*b*) at 2–3 that increases the temperature, entropy and volume of the compressed air in a constant pressure process. The heat used to provide this process is from the heat transferred to the metal parts of the block and the inevitably high temperature exhaust gas 38.

A close examination of the P-V diagrams for each cycle indicates that the Otto cycle pressure increase in the combustion chamber 44 is added to the top of compression point 2 in a straight line, whereas a distinct notch is evident in the present invention process 2–3 before maximum pressure at point 4 is reached. This notch is a result of the added process 2–3 heat regeneration from the block 11 and the exhaust gas 38, increase the volume of the compressed air. The addition and burning of fuel in the constant volume reaction chamber 44*a*, process 3–4, further raises the temperature and pressure of the mixture. In the present invention, this increase does not necessarily provide a work output at this time, but will once the expansion process begins. The waiting period provides sufficient residence time to complete burning of the fuel in a fixed volume before expansion occurs, a feature not possible in present external combustion engines.

A further examination of the P-V diagram of FIG. 9 indicates that the pressure in the present invention rises to a peak which is the result of the operation of the constant volume reaction chamber 44*a*. In contrast, the Otto cycle P-V diagram of FIG. 10 is seen to roll over at the top due to the fuel 47 burning as the piston increases the volume before complete combustion has occurred. It is known that maximum efficiency is obtained when the fuel 47 has completely burned before expansion begins; therefore this feature is utilized in the present invention. At the point in the cycle corresponding to point 4 in the diagram, a maximum temperature and pressure have been reached. The gas is now ready for the expansion process to produce mechanical work.

The maximum efficiency of external combustion engines is obtained when the gas is expanded to an optimum pressure and temperature point in an expander before the exhaust valve opens. The present invention uses this principle. To accomplish this, the expansion process of the present cycle is significantly different than the Otto cycle process 3–4 shown in FIG. 10. The expansion process of the present invention consists of three separate processes. In FIG. 9, state 4 corresponds to zero clearance for the thermal expander 60. Process 4–5 is a first order expansion process as the gas within the constant volume reaction chamber 44*a* expands into the thermal expander 60. Process 5–6 is a constant pressure process as the gas within the constant volume reaction chamber 44*a* is pushed out by spring 50. As can be seen on the T-S graph of FIG. 9, points 5 and 6 occur at a single location since the temperature does not change during this process. This is then followed by process 6–7 final expansion within the thermal expander 60.

The exhaust process in the Otto cycle occurs between the points 4-1 in FIG. 10. As can be seen on the diagram, pressure and temperature at point 4 drop in a straight line as the gas is exhausted to ambient air in a constant volume process. There is a significant difference in the operation of the exhaust method of the present invention which is shown in process 7-0 of FIG. 9.

7-0 is a constant pressure process as the gas 38 is pushed out of the thermal expander 60. The gas 38 has been expanded to ambient pressure to provide maximum cycle efficiency. The high energy content in the form of rejected exhaust heat is removed from the exhaust 38 by the heat exchanger 35 in process 2-3. Therefore, the exhaust gas leaves the cycle at nearly ambient temperature at point 0, and indicates zero entropy due to the zero clearance effect.

Figure 12:
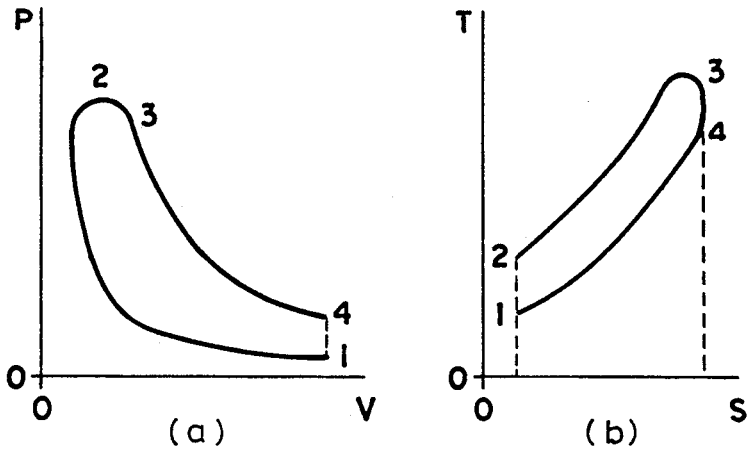
Fig 12 (PRIOR ART)
FIGS. 12*a* and 12*b* show pressure-volume and temperature-entropy graphs for a prior art Diesel engine cycle.
Figure 11:
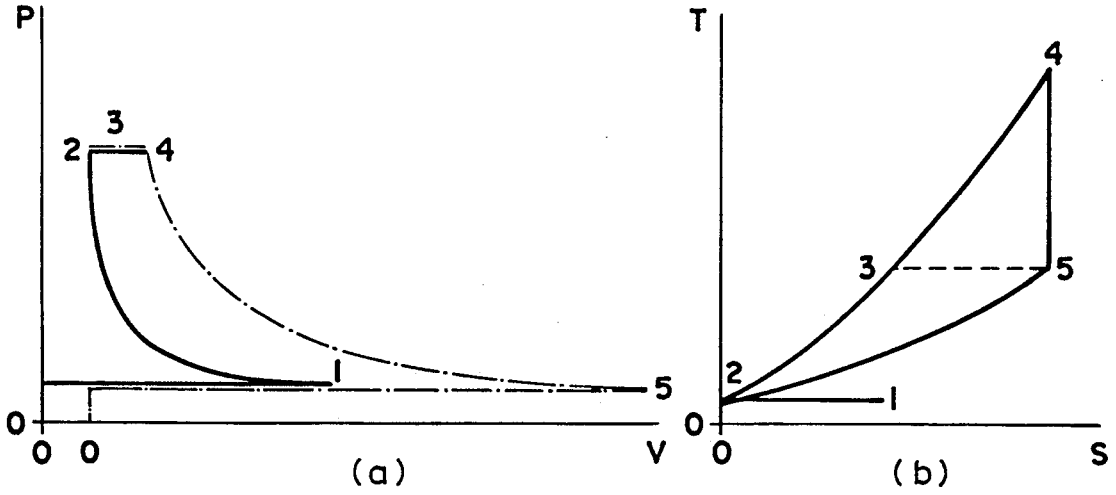
FIGS. 11*a* and 11*b* show pressure-volume and temperature-entropy graphs for the engine cycle of the present invention comprising the constant pressure reaction chamber of FIG. 5.

Just as the cycle of the constant volume reaction chamber 44*a* is similar to the Otto cycle, the cycle of the constant pressure reaction chamber 44*b* is similar to the Diesel cycle. The pressure-volume (P-V) and temperature-entropy (T-S) graphs of the present invention comprising the constant pressure reaction chamber 44*b* and of the Diesel engine are shown in FIGS. 11 and 12, respectively. The thermodynamic advantages of the constant temperature compressor 15 and the heat exchanger 35 are the same for the cycle involving the constant pressure reaction chamber 44*b*. In addition, the expansion process is identical to that of the constant volume reaction chamber 44*a*. However, what occurs in the reaction chamber 44 is different. This discussion thus only involves the thermodynamic principals of the constant pressure reaction chamber 44*b*.

In the Diesel cycle, pressure is near its maximum at point 2 when fuel is added, while volume is near its minimum. The burning of fuel occurs from point 2 to point 3. The piston is moving between points 2 and 3; thus, reduced expansion results for the bunting fuel. However, in the present invention pressure has been raised to the maximum and the volume has been increased from the point 2 to an intermediate point 3 before fuel is added. The burning of fuel occurs in the present invention in the process 3-4. This burning raises the temperature and volume of the mixture. Work output does not occur until the thermal expander 60 process begins. This waiting period provides a sufficient residence time to complete burning of the fuel at constant pressure before the gas starts to expand in the thermal expander 60, a feature not possible in present day Diesel engines. At this point in the cycle, a maximum temperature and volume has been reached to produce mechanical work.

Figure 13:
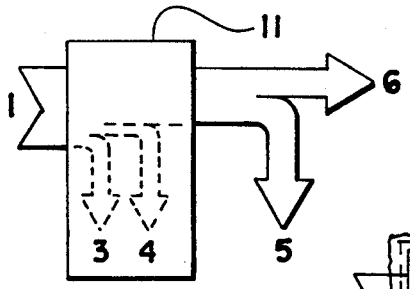
Fig 13 (PRIOR ART)
FIG. 13 shows heat distribution in prior art external combustion engines.

FIG. 13 shows the heat distribution of prior engine designs. The heat of the fuel I is shown to flow into the block 11 where it divides into the branches as shown. Branch 3 represents the heat transferred to the block 11 during compression which is lost when it is transferred to ambient. Branch 4 represents heat transferred to the block 11 during combustion and expansion which is also lost when it is transferred to ambient. This process of transferring conducted heat to ambient is necessary to maintain the operating temperature of the engine 10. Branch 5 represents the heat energy in the exhaust and is shown to be expelled and lost to ambient. The remaining Branch 6 is the useful work output of the engine which is the amount of the heat of fuel 1 converted to actual work after all other losses have been taken into account.

Figure 14:
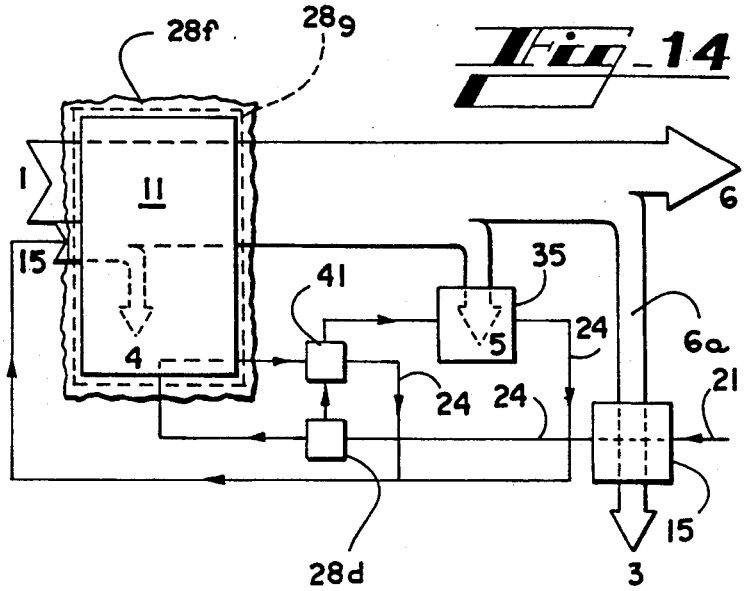
FIG. 14 shows heat distribution for an engine embodying the present invention.

FIG. 14 shows the heat distribution of an engine embodying the present invention. The heat of fuel I is shown to flow into the block 11 where it divides into the branches shown. Also shown flowing into the block 11 along with the heat of fuel 1 is reclaimed heat 1*a* from the heat transferred to the block 11 and exhaust heat 5 captured by the compressed air 24.

Surrounding the block 11 is an outer wall 28*g* which is insulated by insulation 28*f* to prevent heat loss from the block 11, as is shown in FIG. 1. The outer wall 28*g* contains the flow of compressed air 24 in passageway 29 which flows over the hot metal parts of the block 11. As shown, the compressed air 24 flows to the block heat ratio valve 28*d* which will direct compressed air 24 to flow to the block 11 or to the compressed air ratio valve 41. This operation is controlled by the temperature of the block 11. The block heat ratio valve 28*d* will, depending on the block 11 temperature, cause all of or part of the flow of compressed air 24 to pass through block 11. As shown, the compressed air 24 flows through the block 11 removing conducted heat and then it continues to flow to the compressed air ratio valve 41. Depending on operating conditions, the valve 41 will direct the air 24 to flow through the heat exchanger 35 recovering the heat of the exhaust 5 which is seen to flow out of the block 11 along with work output 6. The flow of compressed air 24 passes through the heat exchanger 35 and is seen to flow out of it as heated air 24. If the block 11 is below the set temperature, the block heat ratio valve 28*d* directs the compressed air 24 to flow directly to the compressed air ratio valve 41.

The work output of the block 11 is shown to split into two branches. Branch 6*a* is the work needed to compress input air 21 and is seen to be transferred to ambient at 3. This loss will be much less than the combined losses 3 and 4 of the present engine concepts. The remaining branch 6 is the work output of the present invention after all losses have been accounted for. In this manner, the present invention makes use of the heat normally lost in combustion engines by returning it to the primary cycle and combining it with the heat of fuel 1.

Figure 15A:
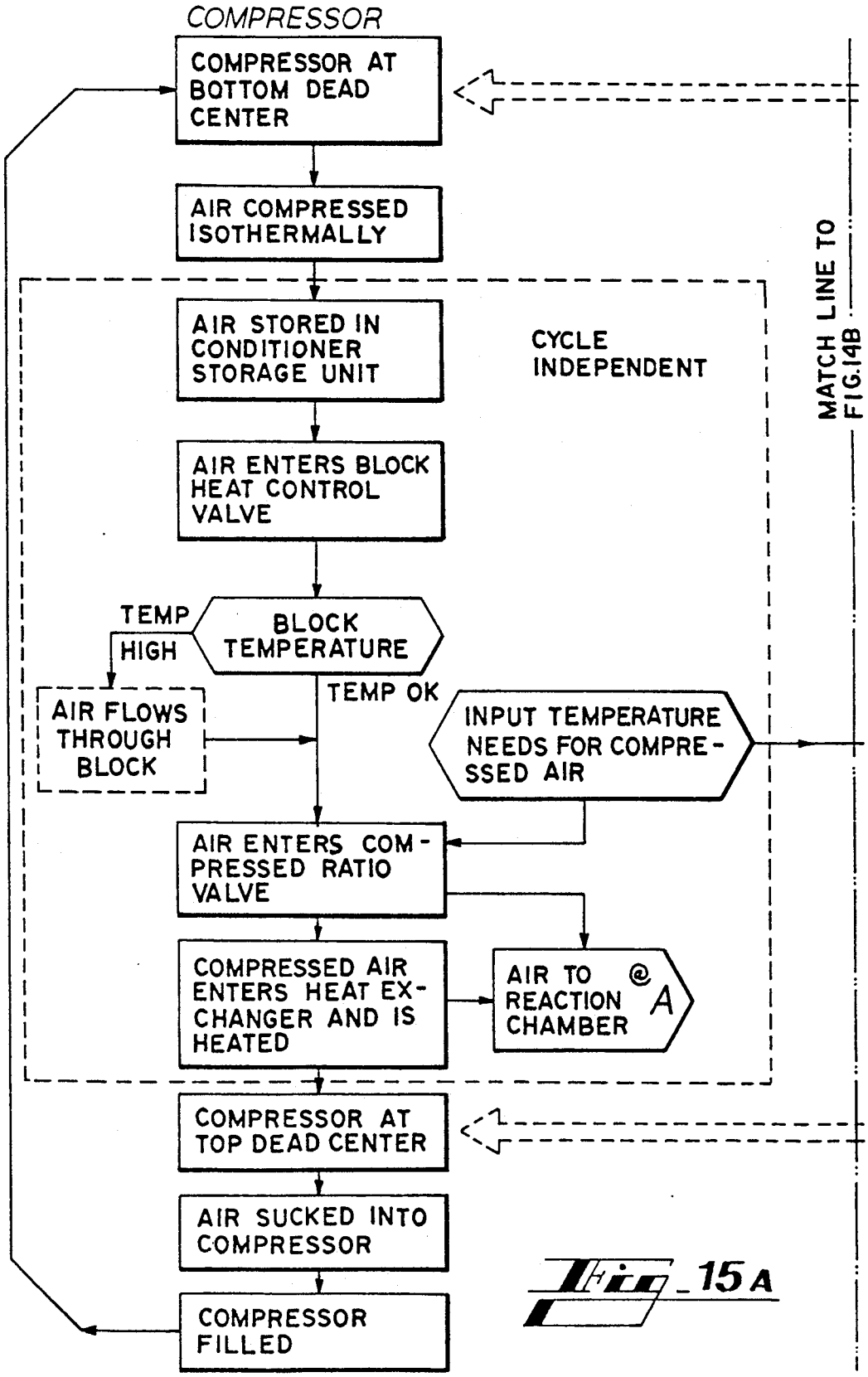
FIGS. 15*a* to 15*c* show a time cycle diagram for an engine embodying the present invention.
Figure 15B:
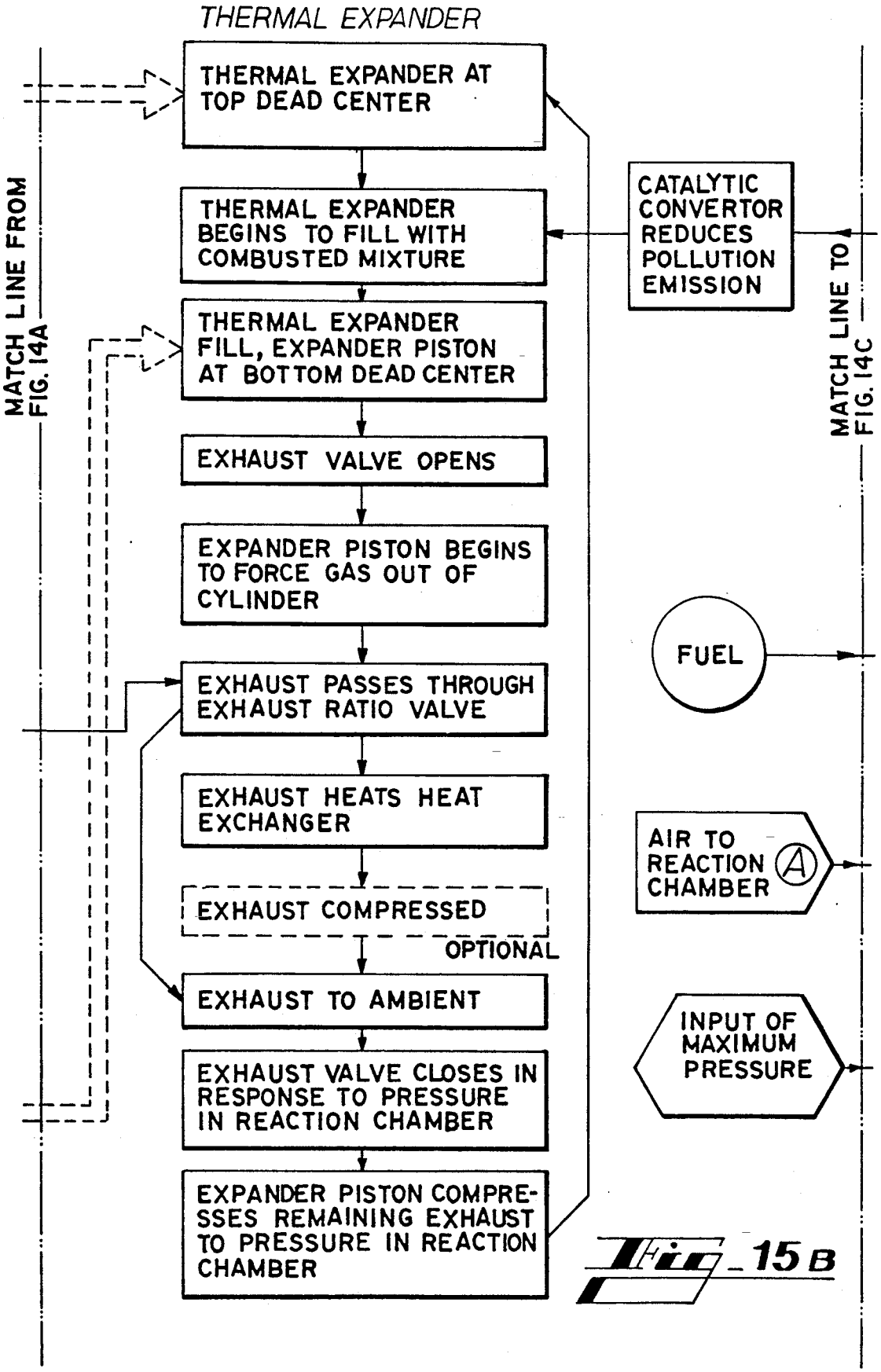
Figure 15C:
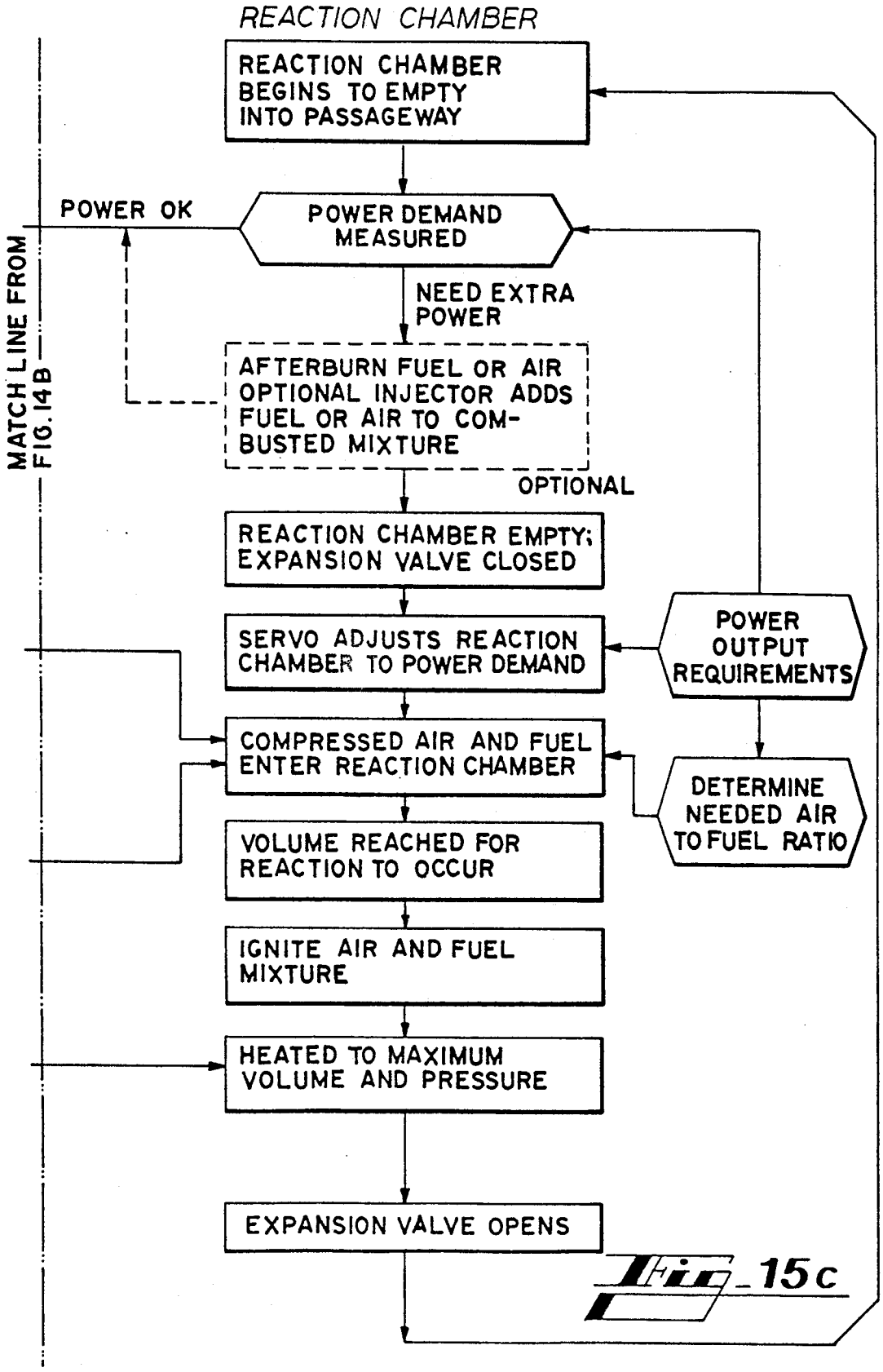

A timing and flow diagram of the cycle of the preferred embodiment of the present invention is depicted in FIG. 15. At the beginning of the cycle, the thermal expander 60 is at top dead center; that is, the thermal expander 60 is nearly empty and has compressed the trapped exhaust gas to the reaction chamber 44 pressure. The thermal expander 60 is prepared for the inlet of combusted gases from the reaction chamber 44.

If the compressor 15 is driven by the work of the expansion cylinder, it is connected to the thermal expander 60 piston 64 by a crank shaft 25. The crank shaft may include a clutch 34 that turns off the compressor 15 piston 16 when the conditioner storage unit 26 has reached the maximum pressure of the system or when the constant temperature compressor 15 is being driven by another source, such as regenerative braking.

The expansion valve 62 opens allowing the hot mixture from the reaction chamber 44 to flow through the passageway 53 and enter into the thermal expander 60. To increase power output the afterburn fuel injector 57 or an afterburn air injector injects fuel 47 or air 24 into the combusted gas flowing into the expander 60. Aside from this one operation, the thermal expander 60 and the reaction chamber 44 work entirely independent of each other.

Expansion continues in the thermal expander 60 until the piston 64 reaches bottom dead center. At the appropriate time, the expansion valve 62 is closed and the exhaust valve 65 is opened, allowing the gas 38 to escape. The piston 64 forces the gas 38 out of the cylinder and through the exhaust ratio valve 40. Depending on temperature needs of the heat exchanger 35, the exhaust gas 38 then flows through the heat exchanger 35 or out to ambient. If the expander 60 was expanded below ambient, the exhaust is compressed at this time. Just prior to the thermal expander 60 reaching its final exhaust point (top dead center), the exhaust valve 65 closes, and the final movement of the thermal expander 60 piston 64 compresses the remaining exhaust to a pressure equal to that of the hot gas in the reaction chamber 44 to eliminate blow down losses.

During expansion in the expansion chamber 60, the compressor 15 is compressing the air 24 isothermally and delivering it to the storage unit 26. Operation of the conditioner storage unit 26 is basically time independent. An input is provided setting the desired temperature for the compressed air 24 to be admitted into the combustion chamber 45, based on the power demand. If the constant ratio compressor 15*a* is used, the air is compressed polytropically and flows to the combustion chamber 45 (not shown in flow chart).

The flow of air leaving the block heat control valve 28*d* is determined by the block temperature sensor (not shown). If the temperature of the block 11 is below a set limit, the air 24 is directed to flow to the compressed air ratio valve 41. However, if the block 11 temperature is above the set temperature limit, the flow of air is directed through the block 11. Appropriate channels direct the flow of air over the heated areas in the block 11, removing excess heat. The heated compressed air 24 then exits the block 11 and flows onto the compressed air ratio valve 41.

The temperature of the compressed air 24 entering the reaction chamber 44 is partially determined by the amount of compressed air 24 flowing through the heat exchanger 35 and the amount and temperature of exhaust 38 that enters the heat exchanger 35. Thus, the temperature of the compressed air 24 may be set and determined by use of the exhaust ratio valve 40 and compressed air ratio valve 41. The former determines the amount of compressed air 24 that is exposed to the high temperatures in the heat exchanger 35; the latter determines the temperature of the heat exchanger 35. The temperature of the compressed air 24 as it reaches the combustion chamber 45 may be monitored by a conventional sensor (not shown), and a conventional feedback circuit (also not shown) may be used to operate the valve 40 to maintain a desired temperature. Operation of the heat exchanger 35 is basically time independent.

Once the gases are expelled into the thermal expander 60, and the valve 62 closes, the reaction chamber 44 is at the beginning of its cycle. An operator or an automatic monitor of operating conditions (not shown) inputs a needed power output of the external combustion engine 10 into a computer (also not shown). The computer determines the combustion volume needed to produce the requested power, and sends this information to the servo 59 of the reaction chamber 44, which in turn adjusts the initial volume or limit of the reaction chamber 44 according to this needed power output. During the exhaust phase of the expander 60 cycle, compressed air 24 and fuel 47 enter the reaction chamber 44. The air 24 fills the chamber to a volume which is determined by the initial volume or limit of the reaction chamber 44, as determined by the springs 50, 56 and/or adjustable stop 54. Whether spring 50, or spring 56 or adjustable stop 54 will be used depends on the configuration of the reaction chamber 44 - constant volume, constant pressure, or constant volume/pressure, as described above. At this point the mixture ignites, and fuel 47 is added gradually causing the temperature to rise which in turn increases the volume or pressure of the mixture. The gas is prepared to refill the thermal expander 60. Combustion can begin at an optimum time well before the expansion piston 64 reaches top dead center to ensure proper combustion of the fuel 47 and reaction with catalytic elements.

The computer described may be a general purpose programmable microprocessor of a type well known to those skilled in the art. Furthermore, such a computer may be programmed by a programmer of ordinary skill to accept the inputs, perform the functions, and provide the outputs required for operation of the present invention, given the description contained herein.

Figure 16:
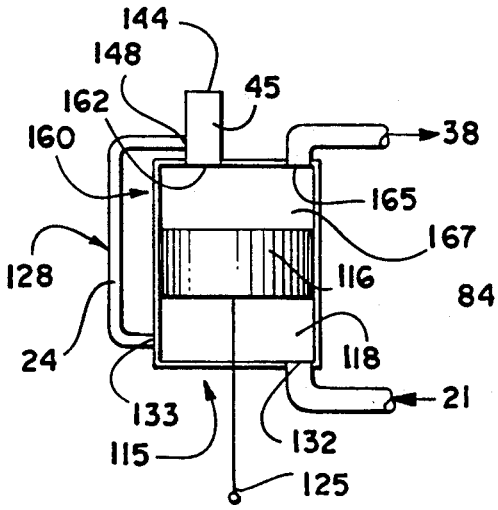
FIG. 16 shows a two cycle engine using the present invention.

The concepts of the present invention may be utilized in a two-stroke engine as well. The structure of the two-stroke engine is depicted in FIG. 16. In the two-stroke embodiment of the present invention, a compressor 115 and a thermal expander 160 share a single cylinder 123 and the same piston 116. The piston 16 separates the compression chamber 118 from an expansion chamber 167 of a thermal expander 160. The combustion chamber 144 is located on top of the cylinder 123 and is connected by a valve 162 to the expansion chamber 167 and by a passageway 128 to the compression chamber 118.

The operation of the two-stroke concept is as follows. When the piston is moving upwards in FIG. 16, ambient air 21 is drawn into the compression cavity 118 through the valve 132 while exhaust 38 is being expelled from the expansion cavity 167. The valve 132 may include a variable orifice to limit air 21 flowing into cavity 118. When the piston 116 reaches the maximum upward position, the exhaust valve 165 and the input air valve 132 would both be closed. When the piston 116 starts down in the power stroke, the expansion valve 162 opens and the combusted mixture of fuel 47 and air 24 in the combustor chamber cavity 145 begins to flow into the expansion cavity 167. When the piston of the combustor 144 has moved the combusted mixture out of the combustor 144, the expansion valve 162 is closed in the early stages of expansion. While the combustion mixture is expanding in the cavity 167, the trapped air 21 in the compression cavity 118 is being compressed. At the appropriate tune, a compressed air valve 133 is opened to allow the compressed air 24 to flow into air passage 128. This causes the compressed air 24 to be forced into the combustor 144 through the input valve 148. As the piston 116 moves to the maximum down position in the figure, the valves 133 and 148 close, trapping the compressed air 24 in the air passageway 128 and the combustor 144. Fuel 47 is added to the compressed air 24 in the combustor 144 while the compressed air 24 in the air passage 128 remains and may be heated by the block surrounding the combustor and/or heat of the exhaust gas 38 until the piston 116 once again forces the compressed air 24 to flow in the air passage 128. This two stroke design may utilize the concepts previously described, since the combustion chamber 144 is still separate from the thermal expander 160 and the compression chamber 115.

Figure 17:
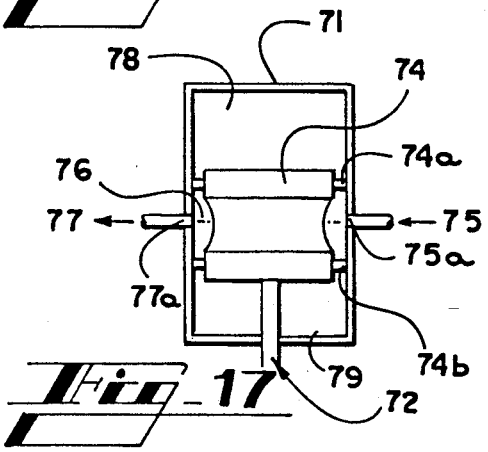
FIG. 17 shows a positive lubrication system for the present invention.

The preferred embodiment of the present invention utilizes a positive lubrication system for the piston rings. Referring to FIG. 17, the cylinder 71 forms the enclosure in which a piston 74 will operate. This arrangement could be used, for example, with the pistons 16, 49, 64 and cylinders 23, 51, 63 described above. As shown, both the top and bottom of the cylinder 71 is closed to allow maximum use of both ends of the piston 74. The piston 74 and the walls of the cylinder 71 form two cavities 78 and 79. A pair of sealing, oil-lubricated rings 74*a* and 74*b* tare located on the top and bottom of the piston 74 for contact with the walls of the cylinder 71. An oil cavity 76 is created by the piston 74 and the rings 74*a* and 74*b* that prevents oil 75 from flowing into the cavities 78 or 79.

To insure proper lubrication and heat removal for the piston 74 and the rings 74*a* and 74*b*, a positive flow of oil 75 is provided. Cooled, clean oil 75 flows into an inlet 75*a* through the cavity 76 and leaves the cylinder 71 as heated oil 77 through an outlet 77*a*. The heated oil 77 flows out of the cavity 76 through the outlet 77*a* and continues on to an oil cleaner and cooler (not shown). The movement of the piston 74 and the rings 74*a* and 74*b* in the cavity 76 is coordinated in such a manner that the inlet 75*a* and the outlet 77*a* are always within the area between the lings 74*a* and 74*b* such that the oil 75 cannot enter the cavities 78 or 79. Because of this construction, the piston 74 can move up and down in the figure while at the same time the oil 75 flows through the cavity 76. The continuing presence of a reserve of oil in the cavity 76 eliminates the problems of dry operation which occur in splash-type lubrications at start up. This design allows the ends of the piston 74 to be at different temperature extremes without much conduction; for instance, the cavity 78 could provide a hot cycle combustion/expansion process while the cavity 79 could provide a cooler cycle air compression operation. Connecting rod 72 could be of hollow construction and receive a portion of the flow of lubricant 75 to further add a cooling effect to cavity 79.

Figure 18A:
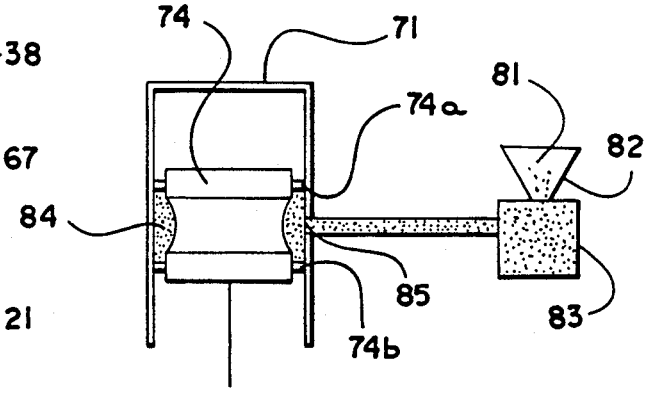
FIG. 18*a* shows an active solid lubricating system for the present invention.
Figure 18B:
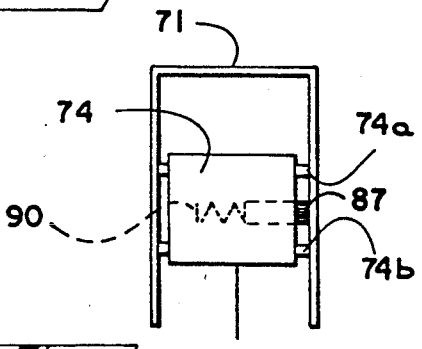
FIG. 18*b* shows an inactive solid lubrication system for the present invention.

An alternative to the positive fluid lubrication system is a solid lubrication system shown in FIG. 18. FIG. 18*a* depicts an active solid lubrication system while FIG. 18*b* depicts an inactive solid lubrication system. To overcome drawbacks of present internal combustion lubrication systems, the present invention provides a solid lubricant system that utilizes graphite to lubricate the rings and cylinder walls. The use of graphite will reduce pollution because it can withstand extremely high temperatures before it decomposes and it provides a lower coefficient of friction than that provided by oil lubricants.

Referring to FIG. 18*a*, an active solid lubrication system is shown. The cylinder 71 walls provide a path in which the piston 74 and the rings 74*a* and 74*b* move. A cavity 84 is formed between tile cylinder 71 walls and the piston 74. In order to provide lubrication for rings 74*a* and 74*b*, a solid state graphite lubricant 81 is used. A storage bin 82 holds a quantity of graphite 81. Graphite 81 flows to a graphite feed device 83 that could consist of a piston or screw conveyor to cause the graphite 81 to be forced through an inlet 85 into the cavity 84 surrounding the piston 74. The operation of the feed device 83 could be controlled by pressure sensors or other suitable means (not shown). The feed device 83 will keep a constant pressure or movement of graphite 81 into the cavity 84. The graphite 81 in the cavity 84 is prevented from flowing out of the cavity 84 by the cylinder 71 walls and rings 74*a* and 74*b*. The inlet 85 is never uncovered thus the graphite 81 can only flow into the cavity 84 even though the piston 74 is moving back and forth in the cylinder 71.

The graphite 81 in the cavity 84 provides the lubrication for the cylinder walls and the rings 74*a* and 74*b*. The cylinder 71 could be etched causing minute cavities to hold the graphite 81 across which the rings 74*a* and 74*b* slide, or the sliding faces of the rings 74*a* and 74*b* could be etched to provide a means to trap graphite 81 between the rings 74*a* and 74*b* and the cylinder 71 walls, or both the walls and the rings could be etched.

In FIG. 18*b* an inactive solid lubrication system is depicted. The operation is very similar to FIG. 18*a*. A difference is that the graphite 81 is provided in the form of a brush 87 which is similar to an electric motor brush. As shown, the brush 87 is installed in a radially aligned cavity in the piston 74, and projects outwardly to engage the cylinder wall. A spring 90 provides a force to keep the brush 87 against the walls of the cylinder 71. The brushes are positioned close to the rings so that the rings will wipe over an area of the cylinder that has been lubricated by the brushes. Several brush segments could be used to encircle piston 74 to provide lubrication over the entire cylinder 71 wall area, thus rings 74*a* and 74*b* will be provided with lubrication from the brush 87. The cylinder 71 walls or the rings 74*a* and 74*b* could be etched as in tile active solid lubrication system to provide a graphite interface between the cylinder 71 walls and the rings 74*a* and 74*b* to enhance the lubrication effect.

Figure 19:
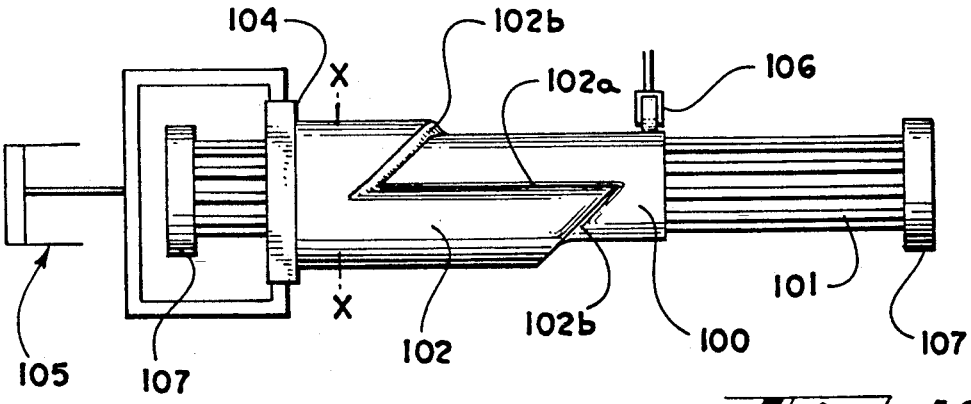
FIG. 19 shows a wide variance valve control system for the present invention.
Figure 20:
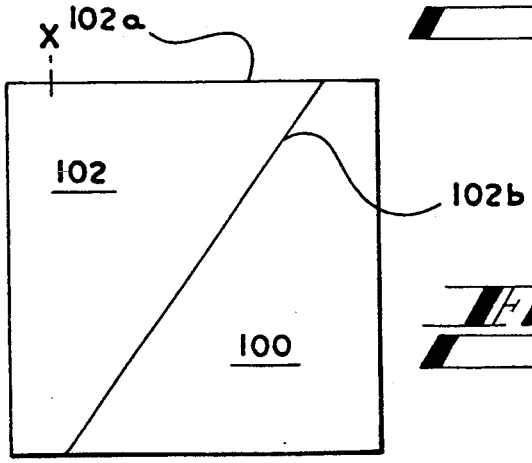
FIG. 20 shows the cam surface of the valve control system of FIG. 19 with the surface laid out flat.

FIG. 19 depicts a wide variance valve control mechanism and is shown in plan view. This valve control system could be used for any of the valves in the present invention, including valves 48, 62, and 65. A cam cylinder 100 is slidably mounted on a splined shaft 101 that is held in place by suitable bearings 107. A cam follower 106 is mounted for rolling engagement with the cylinder 100 and is connected to a valve of conventional design (not shown). A cam lobe 102 is formed on the outer surface of the cylinder 100. A cam edge 102*a* of the lobe 102 runs the length of an active area of the cylinder in a straight line whereas a second cam edge 102*b* of the lobe spirals around the cylinder. As can best be seen in FIG. 20, as the cam lobe 102 increases in width, it eventually wraps completely around the cylinder 100 at the point marked X on the figure. The cain cylinder 100 is journalled to an end bearing 104. A servo mechanism 105 is attached to the end bearing 104 to adjust the position of the cam lobe 102 relative to the valve-operating cam follower 106 by sliding the cylinder 100 along the shaft 101. If tile right hand end of the cylinder 100 is aligned with the follower 106, no lifting is provided. As the servo 105 moves the cylinder 100 to the right, more and more cam lobe 102 area is presented to the follower 106, thereby adjusting the time for which the valve (not shown) is operated. When the servo 105 has moved the cylinder 100 to the maximum right hand position X in the figure, the left end of cam lobe 102 will cause the valve cam follower 106 to be held in the opposite position as when it was aligned with the right hand end of cylinder 100. It should be understood that the cam lobe 102 could provide a constant height lift or it could be designed to open the valve to different heights. This design would allow for infinitely variable adjustment for the movement of the valve and provide means to hold the valve open or closed or allow for various opening-closing timings. The cain lobe edges 102*a* and 102*b* could be designed to provide varied lifting patterns.

From the previous discussion, it is clear that through physical separation of the thermodynamic processes the present invention offers efficiency much beyond that offered in present day engines. Separating the combustion chamber from the expansion and compression chambers permits a greater independence of the fuel and combustion temperature used and allows a greater flexibility in ignition timing. Combustion is maximized because it can occur either at constant volume, constant pressure, or a two stage process involving both. Also, expansion is possible to a much reduced temperature which allows for greater use of ignited gases and lighter system parts. In addition, fuel is added slowly to the air so that a proper stoichiometric mixture may be had for combustion. The air-to-fuel ratio being kept constant and the volume of air being varied according to power demands reduces the operating temperature of the engine and therefore reduces emissions and increases efficiency. Locating the catalytic action in the high density/high temperature gas phase provides the most efficient operation of the catalytic conversion and therefore reduces emissions. Use of the heat of exhaust and heat of the engine block to heat the cooler temperature compressed air before combustion also increases the efficiency of the engine. The lubrication system of the present invention reduces friction between the piston rings and the cylinder walls and prevents dry spot defects inherent in splash-type lubrication systems. Finally, the variable valve control system of the present invention provides the optimum control of valve lift over the speed range of the engine. Each of the components and methods of unproving efficiency described above may be used separately or in combination in present day external combustion engines to provide an improved efficiency, emission-reduced external combustion engine.

While this invention has been described in detail with particular reference to preferred embodiments thereof, it will be understood that variations and modifications can be effected within the spirit and scope of the invention as described hereinbefore and as defined in the appended claims.

What is claimed is:

1. A method of operating an external combustion engine comprising the steps of:

monitoring power demand of said internal combustion engine;

adjusting the internal volume of a combustion chamber from an initial volume which is substantially zero to a set volume in response to said power demand;

admitting a mixture of fuel and air into said combustion chamber; and igniting and combusting said mixture while maintaining said combustion chamber at said set volume.

2. The method of claim 1 further comprising the step of compressing said flow volume of air in a compression chamber external to said combustion chamber prior to delivering said flow volume of air to said combustion chamber.

3. The method of claim 2, wherein said compression chamber is powered by regenerative braking.

4. The method of claim 2, further comprising the step of delivering said compressed air to said combustion chamber at a substantially constant pressure.

5. The method of claim 2, further comprising the step of removing heat formed during said compression at a sufficient rate such that said air in said compression chamber is maintained at a substantially constant temperature during compression.

6. The method of claim 5, wherein said heat is removed by means of injecting liquid droplets into said air being compressed.

7. The method of claim 6, further comprising the step of delivering said compressed air to said combustion chamber at a substantially constant pressure.

8. The method of claim 7, further comprising the step of blowing said compressed air between said block and an insulated layer spaced substantially around said block, such that said compressed air removes a part of the heat from said block and said block heats said compressed air before combustion.

9. The method of claim 7, further comprising the steps of:

biasing a piston in said combustion chamber into an initial position before the admittance of said mixture of said fuel and said compressed air such that an initial volume of said combustion chamber is substantially zero;

admitting said mixture into said combustion chamber such that said piston moves against the force of said biasing until said combustion chamber reaches said set volume;

opening an outlet upon substantial completion of said combustion of said mixture; and forcing said combusted mixture out of said outlet by biasing said piston back to said initial position.

10. The method of claim 9, further comprising the steps of:

closing said outlet at a predetermined time before all of said combusted mixture is formed out of said combustion chamber and said piston reaches said initial position; and moving said piston into said initial position such that the pressure of said combusted mixture remaining inside said combustion chamber when said piston is at said initial piston is substantially equal to the pressure of said mixture of said fuel and said air to be admitted on a next cycle of said piston.

11. The method of claim 7, further comprising the step of adjusting the volume of air entering said compression chamber and the internal volume of said combustion chamber such that a desirable compression ratio is obtained.

12. The method of claim 7, wherein said compressed air is accumulated and held at said constant pressure before combustion.

13. The method of claim 12, further comprising the step of expanding combustion gases from said combustion chamber in an expansion chamber located external to said combustion chamber.

14. The method of claim 13, wherein said compression chamber and said expansion chamber share a common cylinder and a common piston, said piston separating said compression chamber from said expansion chamber.

15. The method of claim 13, wherein said internal combustion engine further comprises:

an expansion chamber including an expansion piston therein, movement of said expansion piston back and forth in said expansion chamber producing work; and a combustion piston within said combustion chamber, movement of said combustion piston back and forth in said combustion chamber causing air to be sucked into said combustion chamber and pushing out combusted air after combustion in said combustion chamber; and further comprising the steps of moving said combustion piston back and forth in said combustion chamber independent of movement of said expansion piston; and moving said expansion piston back and forth in said expansion chamber independent of movement of said combustion piston.

16. The method of claim 15, further comprising the steps of heating said compressed air a first time by passing said exhaust into contact with said block and heating said compressed air a second time with exhaust from said expansion chamber before said compressed air enters said combustion chamber.

17. The method of claim 4, further comprising the step of blowing said compressed air between said block and an insulated layer spaced substantially around said block, such that said compressed air removes a part of the heat from said block and said block heats said compressed air before combustion.

18. The method of claim 4, further comprising the steps of:

biasing a piston in said combustion chamber into an initial position before the admittance of said mixture of said fuel and said compressed air such that an initial volume of said combustion chamber is substantially zero;

admitting said mixture into said combustion chamber such that said piston moves against the force of said biasing until said combustion chamber reaches said set volume;

opening an outlet upon substantial completion of said combustion of said mixture; and forcing said combusted mixture out of said outlet by biasing said piston back to said initial position.

19. The method of claim 18, further comprising the steps of:

closing said outlet at a predetermined time before all of said combusted mixture is foxed out of said combustion chamber and said piston reaches said initial position; and moving said piston into said initial position such that the pressure of said combusted mixture remaining inside said combustion chamber when said piston is at said initial piston is substantially equal to the pressure of said mixture of said fuel and said air to be admitted on a next cycle of said piston.

20. The method of claim 4, wherein said compressed air is accumulated and held before combustion to maintain said constant pressure.

21. The method of claim 4, further comprising the step of expanding combustion gases from said combustion chamber to an expansion chamber located external to said combustion chamber.

22. The method of claim 21, further comprising the steps of heating said compressed air a first time by passing said exhaust into contact with said block and heating said compressed air a second time with exhaust from said expansion chamber before said compressed air enters said combustion chamber.

23. The method of claim 21, further comprising the step of injecting fuel or compressed air between said combustion chamber and said expansion chamber to provide constant temperature expansion.

24. The method of claim 21, wherein said compression chamber and said expansion chamber share a common cylinder and a common piston, said piston separating said compression chamber from said expansion chamber.

25. The method of claim 21, wherein catalytic conversion occurs in the high temperature/pressure phase of combustion.

26. The method of claim 21, further comprising the steps of isolating said combustion chamber from said expansion chamber; and further expanding said expansion chamber to a pressure below ambient.

27. The method of claim 4, further comprising a step of adjusting the volume of air entering said compression chamber and the internal volume of said combustion chamber such that a desirable compression ratio is obtained.

28. The method of claim 27, further comprising the step of expanding combustion gases from said combustion chamber to an expansion chamber located external to said combustion chamber.

29. The method of claim 27, further comprising the steps of:

biasing a piston in said combustion chamber into an initial position with a biasing means before the admittance of said mixture of said fuel and said compressed air such that an initial volume of said combustion chamber is substantially zero;

admitting said mixture such that said piston moves against the force of such biasing means until said combustion chamber reaches said constant volume;

opening an outlet upon substantial completion of said combustion of said mixture; and forcing said combusted mixture out of said outlet by biasing said piston back to said initial position.

30. The method of claim 29, further comprising the steps of:

closing said outlet at a predetermined time before all of said combusted mixture is foxed out of said combustion chamber and said piston reaches said initial position; and moving said piston into said initial position such that the pressure of said combusted mixture remaining inside said combustion chamber when said piston is at said initial position is substantially equal to the pressure of said mixture of said fuel and said air to be admitted on a next cycle of said piston.

31. The method of claim 1, further comprising the steps of:

biasing a piston in said combustion chamber into an initial position before the admittance of said mixture of said fuel and said compressed air;

admitting said mixture such that said piston moves against the force of said biasing until said combustion chamber reaches said set volume;

opening an outlet upon substantial completion of said combustion of said mixture; and forcing said combusted mixture out of said outlet by biasing said piston back to said initial position.

32. The method of claim 31, further comprising the steps of:

closing said outlet at a predetermined time before all of said combusted mixture is formed out of said combustion chamber and said piston reaches said initial position; and moving said piston into said initial position such that the pressure of said combusted mixture remaining inside said combustion chamber when said piston is at said initial position is substantially equal to the pressure of said mixture of said fuel and said air to be admitted on a next cycle of said piston.

33. The method of claim 6, further comprising the steps of:

removing said liquid from the formed mixture of said air and said liquid so as to form separate liquid and dry compressed air; and routing said dry, compressed air to said combustion chamber so that said compressed air may be used in said combustion.

34. An external combustion engine, comprising:

means for monitoring power demand of said internal combustion engine;

means for adjusting the internal volume of a combustion chamber from an initial volume which is substantially zero to a set volume in response to said power demand;

means for admitting a mixture of fuel and air into said combustion chamber; and means for igniting and combusting said mixture while maintaining said combustion chamber at said set volume.

35. The external combustion engine of claim 34, further comprising a compression chamber external to said combustion chamber, from which said flow volume of air is delivered.

36. The external combustion engine of claim 35, further comprising means for removing the heat formed during compression in said compression chamber at a sufficient rate such that said air in said compression chamber is maintained at a substantially constant temperature process during compression.

37. The external combustion engine of claim 36, wherein said substantially constant temperature is maintained by means for injecting liquid droplets into said air being compressed.

38. The external combustion engine of claim 37, further comprising means for delivering said compressed air to said combustion chamber at a substantially constant pressure.

39. The external combustion engine of claim 38, further comprising means for adjusting the volume of air entering said compression chamber and the internal volume of said combustion chamber such that a desirable compression ratio may be obtained.

40. The external combustion engine of claim 39, further comprising:

an expansion chamber including an expansion piston therein, movement of said expansion piston back and forth and forth in said expansion chamber producing work;

a combustion piston within said combustion chamber, movement of said combustion piston back and forth in said combustion chamber causing air to be sucked into said combustion chamber and pushing out combusted air after combustion in said combustion chamber; and said expansion piston and said combustion piston being movable independent of one another.

41. The external combustion engine of claim 40, further comprising:

means for heating said compressed air a first time with exhaust from said expansion chamber before said compressed air enters said combustion chamber; and means for heating said compressed air a second time by passing said compressed air into contact with said block.

* * * * *